US010661560B2

(12) United States Patent
Nakajima et al.

(10) Patent No.: US 10,661,560 B2
(45) Date of Patent: May 26, 2020

(54) LIQUID DISCHARGING APPARATUS

(71) Applicant: Seiko Epson Corporation, Tokyo (JP)

(72) Inventors: Akira Nakajima, Matsumoto (JP); Kunihiro Kawada, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/204,484

(22) Filed: Nov. 29, 2018

(65) Prior Publication Data

US 2019/0160811 A1 May 30, 2019

(30) Foreign Application Priority Data

Nov. 30, 2017 (JP) ..... 2017-231076

(51) Int. Cl.
*B41J 2/14* (2006.01)
*B41J 2/045* (2006.01)

(52) U.S. Cl.
CPC ..... *B41J 2/04541* (2013.01); *B41J 2/04586* (2013.01); *B41J 2/1433* (2013.01); *B41J 2/14233* (2013.01); *B41J 2002/14491* (2013.01); *B41J 2202/20* (2013.01)

(58) Field of Classification Search
CPC .. B41J 2/04541; B41J 2/1433; B41J 2/04586; B41J 2002/14491
See application file for complete search history.

(56) References Cited

U.S. PATENT DOCUMENTS 6,536,882 B1 * 3/2003 Hawkins ..... B41J 2/03 347/77
2010/0134821 A1 * 6/2010 Wasamoto ..... G07G 5/00 358/1.14
2014/0285552 A1 9/2014 Otsuka et al.
2016/0009081 A1 1/2016 Otsuka et al.
2016/0136950 A1 * 5/2016 Date ..... B41J 2/14201

FOREIGN PATENT DOCUMENTS

JP 6119347 B2 4/2017

* cited by examiner

*Primary Examiner* — Sharon A. Polk
(74) *Attorney, Agent, or Firm* — Harness, Dickey & Pierce, P.L.C.

(57) ABSTRACT

A liquid discharging apparatus includes a first substrate which includes a drive circuit which generates a drive signal and a first connector, a discharge head which includes greater than or equal to 300 nozzles per inch and a total of greater than or equal to 600 nozzles, which receives the drive signal and which discharges a liquid from the nozzles, and a second substrate which includes a second connector which is connected to the first connector, in which at least one of the first connector and the second connector includes a detection terminal for detecting a connection with the other of the first connector and the second connector.

7 Claims, 15 Drawing Sheets

LIQUID DISCHARGING APPARATUS

The entire disclosure of Japanese Patent Application No. 2017-231076, filed Nov. 30, 2017 is expressly incorporated by reference herein.

BACKGROUND

1. Technical Field

The present invention relates to a liquid discharging apparatus.

2. Related Art

There is known an ink jet printer (a liquid discharging apparatus) which uses piezoelectric elements or the like and which discharges a liquid such as an ink to print images and text. The piezoelectric elements are provided to correspond to each of a plurality of nozzles in a print head, and due to each piezoelectric element being driven according to a drive signal, a predetermined amount of the liquid is discharged at a predetermined timing from the nozzle to form a dot on a medium.

Japanese Patent No. 6,119,347 discloses an ink jet printer which applies a control signal (a drive signal) corresponding to an ink amount to be discharged to one electrode of a piezoelectric element, applies a holding signal (a fixed voltage signal) to another electrode, and drives (displaces) the piezoelectric element using the potential difference between the drive signal and the fixed voltage signal to discharge an ink.

The ink jet printer is provided with a plurality of circuits such as a circuit which generates a power voltage which is supplied by an industrial power source and which is used by the ink jet printer, a circuit which generates a drive signal and a fixed voltage signal which are applied to the piezoelectric element, and a circuit which controls the timing at which to apply the drive signal to the piezoelectric element, and the plurality of circuits are installed on a plurality of circuit boards. Therefore, the plurality of circuit boards are electrically connected to each other using a flexible flat cable (FFC), a flexible printed circuit (FPC), a board-to-board (B-to-B) connector, or the like.

In a method of directly connecting two circuit boards using a B-to-B connector, it is possible to dispose more circuit boards in less space by providing a plurality of circuit boards to stand on a single circuit board. Therefore, for example, by connecting a drive circuit board on which the drive circuit which generates the drive signal is installed on a predetermined substrate using the B-to-B connector, it is possible to provide a liquid discharging apparatus capable of driving more nozzle while reducing an increase in the size of the liquid discharging apparatus, and so it is possible to further improve the printing precision.

However, when the number of nozzles (piezoelectric elements) which are driven by drive circuits which are provided on the drive circuit board increases, the number of signals to be input to the drive circuit board also increases. Accordingly, in the B-to-B connector which inputs the signals to the drive circuit board, there is a demand for an increase in the number of terminals to be provided and an increase in the density of the terminals, and there is an increased concern of the occurrence of connection faults in the B-to-B connector for inputting the signals to the drive circuit board. In a case in which connection faults occur in the B-to-B connector for inputting the signals to the drive circuit board, there are problems such as a concern of appropriate drive signals not being generating and the occurrence of discharge faults.

SUMMARY

An advantage of some aspects of the invention is to provide a liquid discharging apparatus capable of reducing connection faults in a B-to-B connector.

The invention can be realized in the following aspects or application examples.

Application Example 1

According to this application example, there is provided a liquid discharging apparatus which includes a first substrate which includes a drive circuit which generates a drive signal and a first connector, a discharge head which includes greater than or equal to 300 nozzles per inch and a total of greater than or equal to 600 nozzles, which receives the drive signal and which discharges a liquid from the nozzles, and a second substrate which includes a second connector which is connected to the first connector, in which at least one of the first connector and the second connector includes a detection terminal for detecting a connection with the other of the first connector and the second connector.

The first connector and the second connector may function as a board-to-board (B-to-B) connector which connects the first substrate and the second substrate to each other.

In the liquid discharging apparatus according to the application example, the drive circuit which generates the drive signal and the first connector are provided on the first substrate and the first connector is connected to the second connector which is provided on the second substrate. At this time, the detection terminal for detecting the connection between the first connector and the second connector is provided on at least one of the first connector and the second connector. Accordingly, it is possible to directly detect whether the connection between the first connector and the second connector is good or poor based on a signal which is propagated by the first connector and the second connector using the detection terminal. Accordingly, it is possible to increase the precision of the detection of the connection between the first connector and the second connector, and it is possible to reduce connection faults which arise between the first connector and the second connector.

In the liquid discharging apparatus according to the application example, the drive circuit which is provided on the first substrate generates drive signals for causing the liquid to be discharged from the nozzles which are provided in the discharge head. Accordingly, when many (greater than or equal to 300 nozzles per inch and a total of greater than or equal to 600) nozzles are provided per inch in the discharge head, many signals corresponding to the number of nozzles are input to the first substrate which includes the drive circuit via the first connector. Therefore, many terminals are provided on the first connector.

Even if the first connector includes many terminals, in the liquid discharging apparatus according to the application example, since it is possible to directly detect whether the connection between the first connector and the second connector is good or poor based on a signal which is propagated by the first connector and the second connector using the detection terminal, it is possible to increase the precision of the detection of the connection between the first connector and the second connector. Therefore, even in a case in which many terminals are provided on the first connector, it is possible to reduce connection faults which arise between the first connector and the second connector.

Application Example 2

In the liquid discharging apparatus according to the application example, the first connector includes a plurality of first terminals which form a first terminal row, the plurality of first terminals includes the detection terminal, and the detection terminal is provided on one end portion side or both end portion sides of the first terminal row.

In the liquid discharging apparatus according to the application example, the detection terminal which is included in the plurality of first terminals is provided on one end portion side or both end portion sides of the first terminal row. When the second connector is connected to the first connector in a slanted manner, the connection faults between the first connector and the second connector become notable at the end portion sides of the first connector and the second connector. Therefore, by providing the detection terminal on one end portion side or on both end portion sides of the first terminal row, it is possible to further increase the precision of the detection of the connection between the first connector and the second connector. Accordingly, it is possible to further reduce the connection faults which arise between the first connector and the second connector.

Application Example 3

In the liquid discharging apparatus according to the application example, the second connector includes a plurality of second terminals which form a second terminal row, the plurality of second terminals includes the detection terminal, and the detection terminal is provided on one end portion side or both end portion sides of the second terminal row.

In the liquid discharging apparatus according to the application example, the detection terminal which is included in the plurality of second terminals is provided on one end portion side or both end portion sides of the second terminal row. When the second connector is connected to the first connector in a slanted manner, the connection faults between the first connector and the second connector become notable at the end portion sides of the first connector and the second connector. Therefore, by providing the detection terminal on one end portion side or on both end portion sides of the second terminal row, it is possible to further increase the precision of the detection of the connection between the first connector and the second connector. Accordingly, it is possible to further reduce the connection faults which arise between the first connector and the second connector.

Application Example 4

In the liquid discharging apparatus according to the application example, the discharge head includes a plurality of discharge modules, the nozzles which are provided at greater than or equal to 300 nozzles per inch and a total of greater than or equal to 600 nozzles are provided on each of the plurality of discharge modules, and the drive signal is supplied to each of the plurality of discharge modules.

In the liquid discharging apparatus according to the application example, the greater than or equal to 300 nozzles which are provided per inch and a total of greater than or equal to 600 nozzles are provided for each of the plurality of discharge modules. The plurality of discharge modules is provided in the discharge head. Therefore, an exceedingly large number of nozzles are provided on the discharge head. Still more signals corresponding to the number of nozzles are input, via the first connector, to the first substrate which includes the drive circuit which generates the drive signal to be supplied to the discharge head having the many nozzles. Therefore, still more terminals are provided on the first connector. However, in the liquid discharging apparatus according to the application example, since it is possible to perform the detection of the connection between the first connector and the second connector with higher precision, even in a case in which an exceedingly large number of terminals are provided on the first connector, it is possible to reduce connection faults which arise between the first connector and the second connector.

Application Example 5

In the liquid discharging apparatus according to the application example, a plurality of the first substrates is connected to the second substrate, and a plurality of the discharge heads is provided corresponding to the plurality of first substrates.

In the liquid discharging apparatus according to the application example, since it is possible to precisely perform the detection of whether the connection between the first connector and the second connector which connect the individual first substrates and the individual second substrates to each other is good or poor, even in a case in which the plurality of first substrates is provided for the second substrate, it is possible to reduce connection faults which arise between the first connector and the second connector.

Application Example 6

The liquid discharging apparatus according to the application example further includes a detection circuit which detects a connection between the first connector and the second connector, in which the detection circuit includes a comparator, and in which the comparator includes a first input terminal which is connected to the detection terminal, a second input terminal which receives a reference potential, and an output terminal which outputs a signal indicating a result of a comparison between the first input terminal and the second input terminal.

In the liquid discharging apparatus according to the application example, a comparing circuit inputs a signal which is propagated by the detection terminal to the comparator and detects the connection between the first connector and the second connector by comparing a voltage value of a signal which is input to the comparator and a voltage value of a predetermined reference potential. In other words, the detection circuit is capable of directly detecting the signal which is propagated by the detection terminal. Therefore, it is possible to perform the detection of the connection between the first connector and the second connector with high precision. Accordingly, it is possible to reduce the connection faults which arise between the first connector and the second connector.

Application Example 7

According to this application example, there is provided a liquid discharging apparatus which includes a first substrate which includes a drive circuit which generates a drive signal and a first connector, a discharge head which includes greater than or equal to 300 nozzles per inch and a total of greater than or equal to 600 nozzles, which receives input of the drive signal and which discharges a liquid from the nozzles, a second substrate which includes a second connector which is connected to the first connector, a detection terminal which is provided on the first connector or the second connector, and a comparator which includes a first input terminal which is connected to the detection terminal, a second input terminal which receives input of a reference potential, and an output terminal which outputs a result of a comparison between the first input terminal and the second input terminal.

In the liquid discharging apparatus according to the application example, the drive circuit which generates the drive signal and the first connector are provided on the first substrate and the first connector is connected to the second connector which is provided on the second substrate. At this time, the detection terminal for detecting the connection between the first connector and the second connector is provided on at least one of the first connector and the second connector. Accordingly, it is possible to directly detect whether the connection between the first connector and the second connector is good or poor based on a signal which is propagated by the first connector and the second connector using the detection terminal. Accordingly, it is possible to increase the precision of the detection of the connection between the first connector and the second connector, and it is possible to reduce connection faults which arise between the first connector and the second connector.

In the liquid discharging apparatus according to the application example, the signal which is propagated by the detection terminal is input to the comparator and the connection between the first connector and the second connector is detected by comparing the voltage value of the signal which is input to the comparator and the voltage value of the predetermined reference potential. In other words, it is possible to directly detect the signal which is propagated by the detection terminal using the comparator. Therefore, it is possible to perform the detection of the connection between the first connector and the second connector with high precision. Accordingly, it is possible to reduce the connection faults which arise between the first connector and the second connector.

In the liquid discharging apparatus according to the application example, the drive circuit which is provided on the first substrate generates drive signals for causing the liquid to be discharged from the nozzles which are provided in the discharge head. Accordingly, when many (greater than or equal to 300 nozzles per inch and a total of greater than or equal to 600) nozzles are provided per inch in the discharge head, many signals corresponding to the number of nozzles are input to the first substrate which includes the drive circuit via the first connector. Therefore, many terminals are provided on the first connector.

Even if the first connector includes many terminals, in the liquid discharging apparatus according to the application example, since it is possible to directly detect whether the connection between the first connector and the second connector is good or poor based on a signal which is propagated by the first connector and the second connector using the detection terminal, it is possible to increase the precision of the detection of the connection between the first connector and the second connector. Therefore, even in a case in which many terminals are provided on the first connector, it is possible to reduce connection faults which arise between the first connector and the second connector.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a detailed description will be given of a favorable embodiment of the invention using the drawings. The drawings which are used are for the convenience of explanation. The embodiments described hereinafter are not to be construed as inappropriately limiting the content of the invention. All of the configurations which are described hereinafter are not necessarily essential constituent elements of the invention.

Hereinafter, a description will be given of the liquid discharging apparatus according to the invention, exemplifying an ink jet printer which is a printing apparatus.

1. Outline of Liquid Discharging Apparatus

A description will be given of the configuration of a liquid discharging apparatus 1 in the present embodiment using FIGS. 1 to 4.

Figure 1:
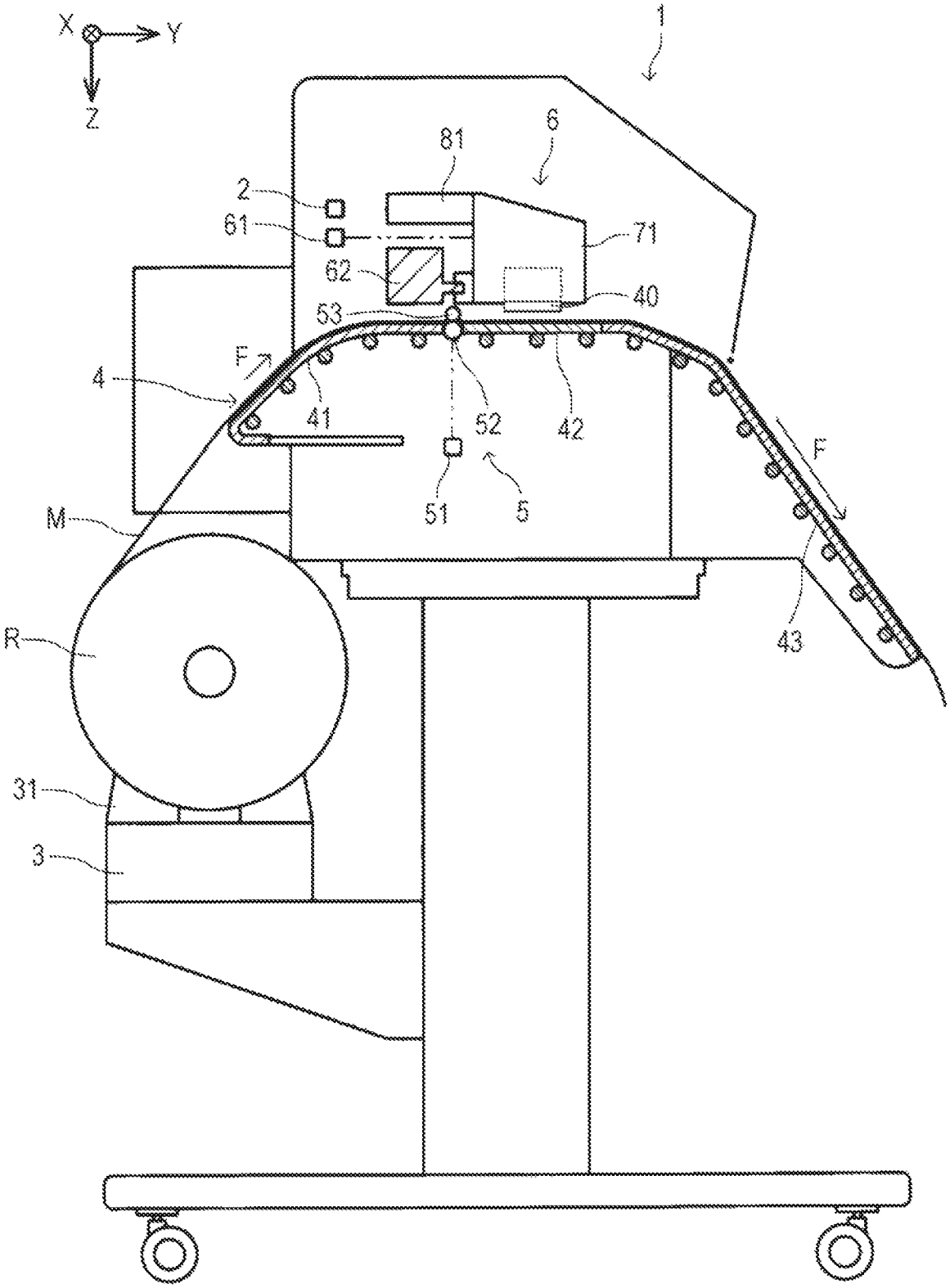
FIG. 1 is a lateral view illustrating a configuration of a liquid discharging apparatus.
Figure 2:
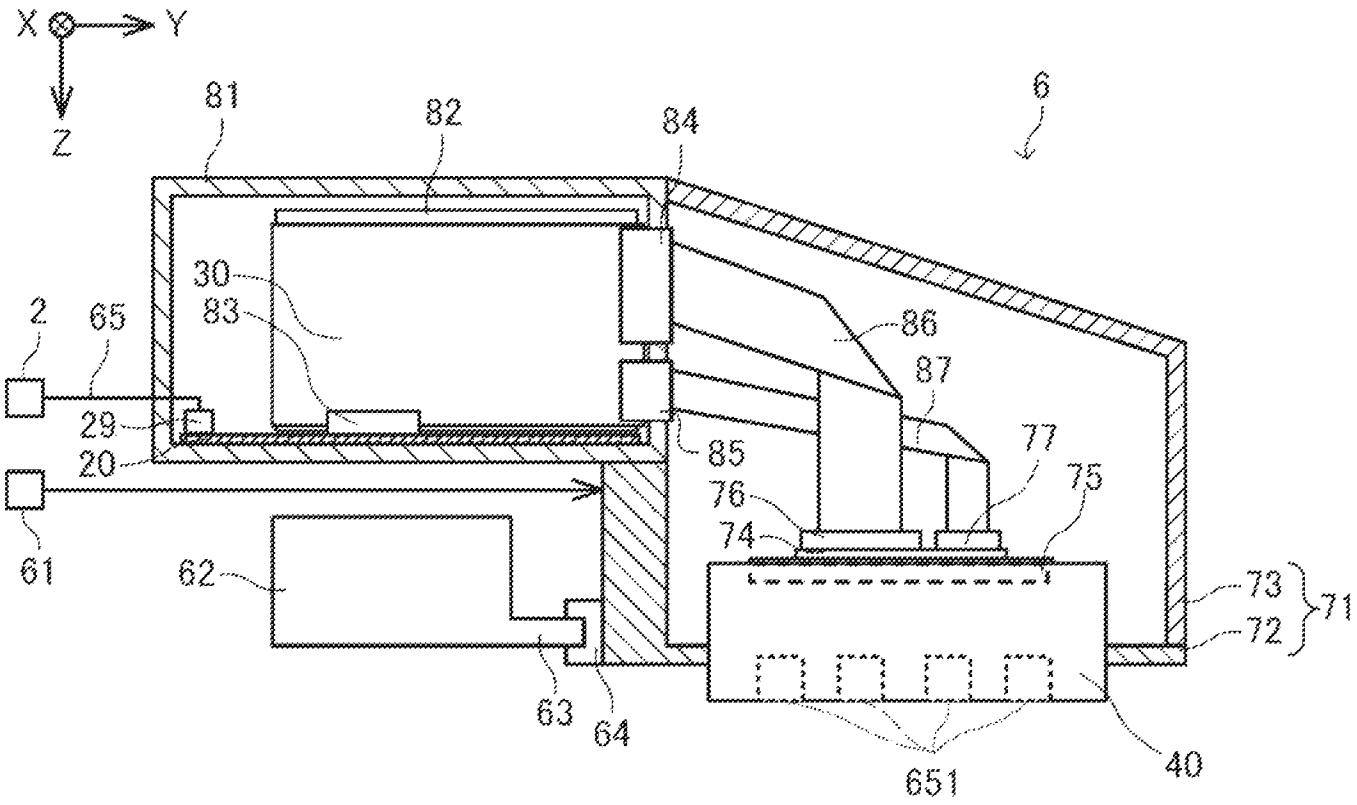
FIG. 2 is a lateral view illustrating a peripheral configuration of a printing unit of the liquid discharging apparatus.
Figure 3:
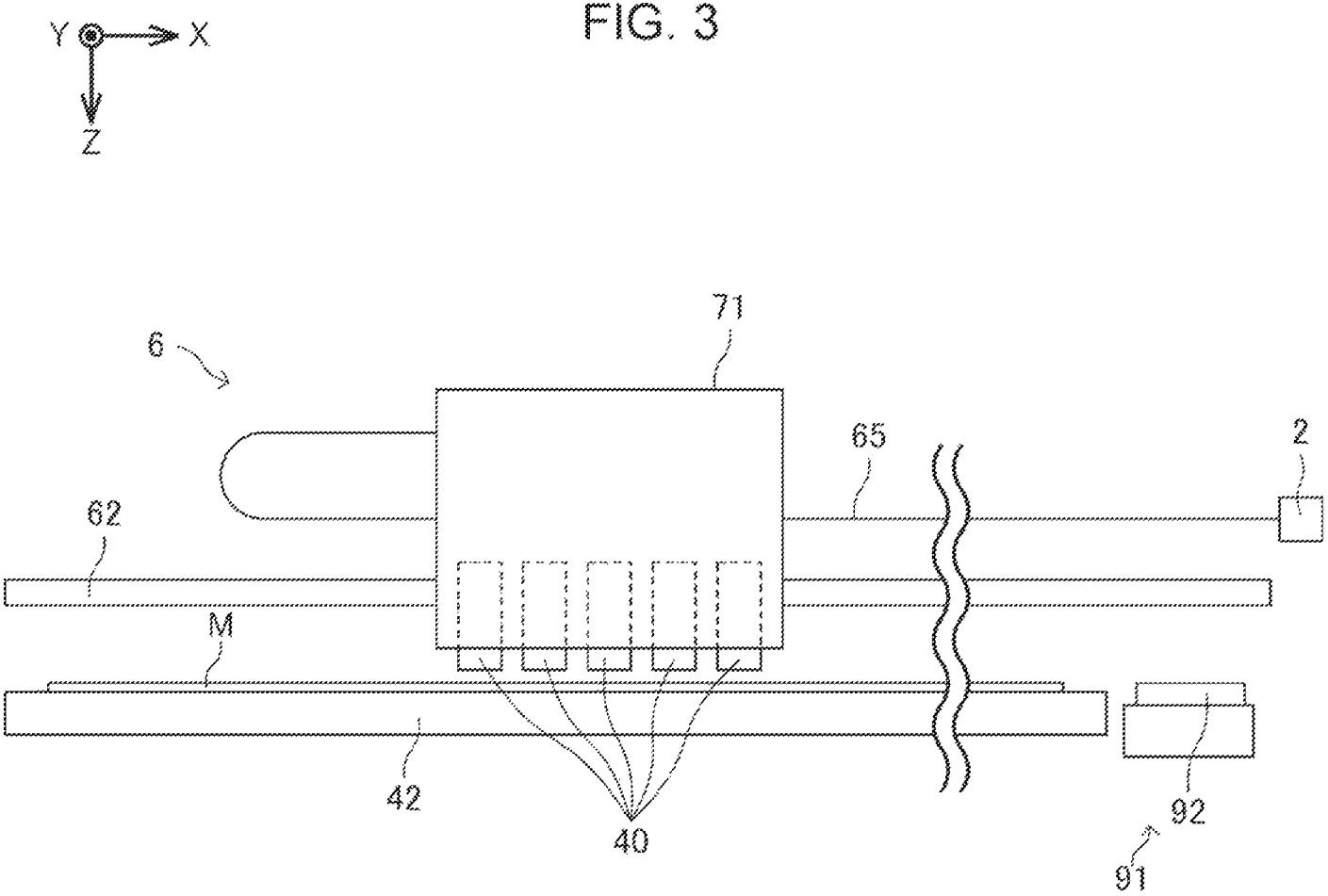
FIG. 3 is a front view illustrating the peripheral configuration of the printing unit of the liquid discharging apparatus.
Figure 4:
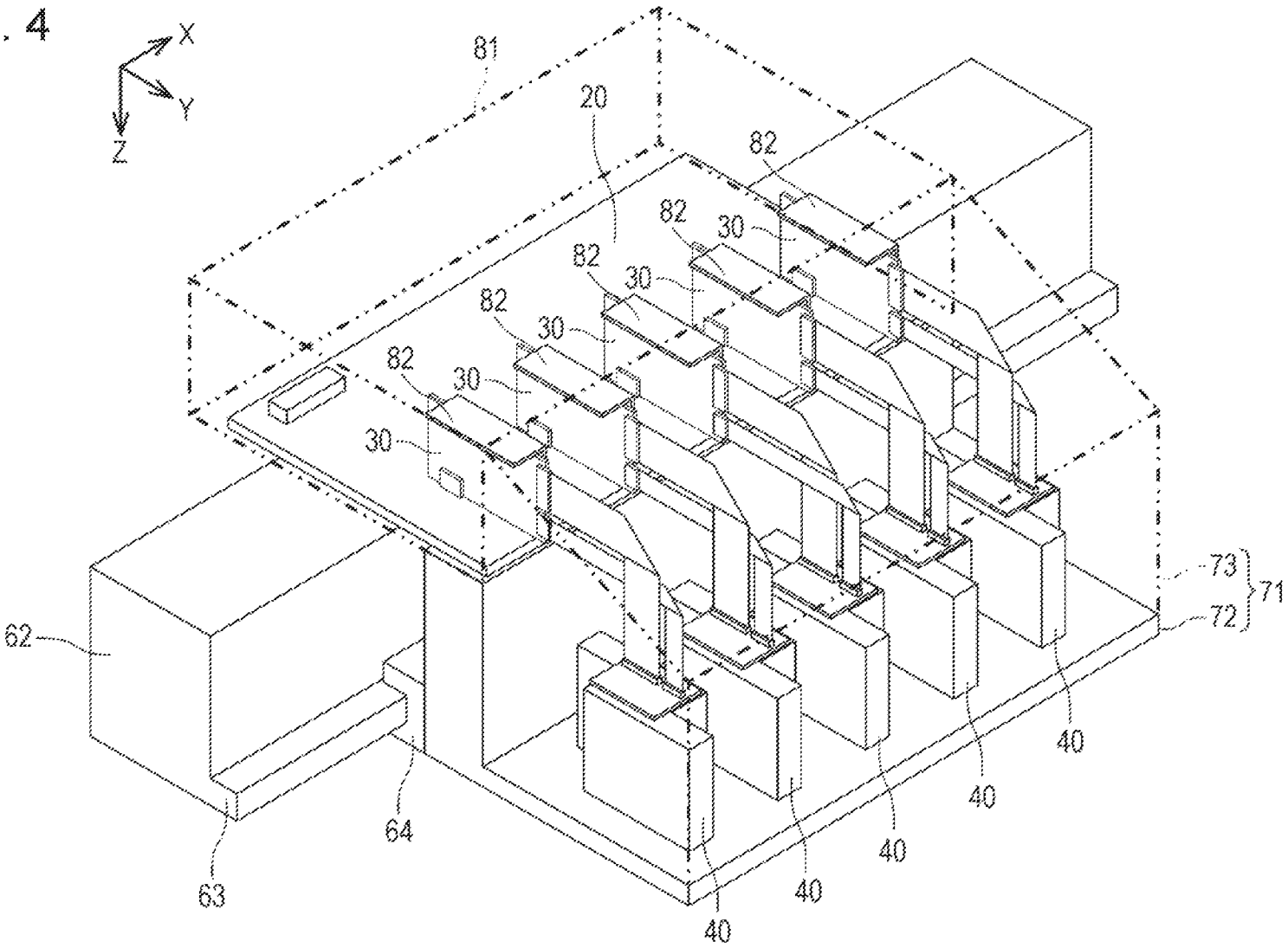
FIG. 4 is a perspective view illustrating the peripheral configuration of the printing unit of the liquid discharging apparatus.

FIG. 1 is a lateral view illustrating a configuration of the liquid discharging apparatus 1. FIG. 2 is a lateral view illustrating a peripheral configuration of a printing unit 6 of the liquid discharging apparatus 1. FIG. 3 is a front view illustrating the peripheral configuration of the printing unit 6 of the liquid discharging apparatus 1. FIG. 4 is a perspective view illustrating the peripheral configuration of the printing unit 6 of the liquid discharging apparatus 1.

As illustrated in FIG. 1, the liquid discharging apparatus 1 is provided with a feed-out unit 3, a support portion 4, a transport unit 5, a printing unit 6, and a control unit. The feed-out unit 3 feeds out a medium M, the support portion 4 supports the medium M, the transport unit transports the medium M, the printing unit 6 performs printing on the medium M, and a control unit 2 controls these constituent elements of the liquid discharging apparatus 1.

In the following description, a width direction of the liquid discharging apparatus 1 is "a scanning direction X", a depth direction of the liquid discharging apparatus 1 is "a front-rear direction Y", a height direction of the liquid discharging apparatus 1 is "a vertical direction Z", and a direction in which the medium M is transported is "a transport direction F". The scanning direction X, the front-rear direction Y, and the vertical direction Z are intersecting (orthogonally intersecting) directions and the transport direction F is a direction which intersects (orthogonally intersects) the scanning direction X.

The feed-out unit 3 includes a holding member 31 which holds a roll body R on which the medium M is wound such that the roll body R is capable of rotating. Different types of the medium M and roll bodies R having different dimensions in the scanning direction X are held on the holding member 31. In the feed-out unit 3, the medium M which is unwound from the roll body R is fed out toward the support portion 4 by causing the roll body R to rotate in one direction (the clockwise direction in FIG. 1).

The support portion 4 is provided with, from upstream toward downstream in the transport direction F, a first support portion 41, a second support portion 42, and a third support portion 43 which configure the transport path of the medium M. The first support portion 41 guides the medium M which is fed out from the feed-out unit 3 toward the second support portion 42, the second support portion 42 supports the medium M on which the printing is performed, and the third support portion 43 guides the printed medium M toward downstream in the transport direction F.

The transport unit 5 is provided with a transport roller 52, a driven roller 53, and a rotating mechanism 51. The transport roller 52 applies a transporting force to the medium M, the driven roller 53 presses the medium M against the transport roller 52, and the rotating mechanism 51 drives the transport roller 52. The transport roller 52 and the driven roller 53 are rollers which use the scanning direction X as an axial direction.

The transport roller 52 is disposed under the transport path of the medium M in the vertical direction Z and the driven roller 53 is disposed above the transport path of the medium M in the vertical direction Z. The rotating mechanism 51 is configured by a motor, a speed reducer, and the like, for example. In the transport unit 5, the medium M is transported in the transport direction F by causing the transport roller 52 to rotate in a state in which the medium M is pinched by the transport roller 52 and the driven roller 53.

As illustrated in FIGS. 2 and 3, the printing unit 6 is provided with a guide member 62, a carriage 71, a plurality of (in the present embodiment, five) discharge heads 40, and a movement mechanism 61. The guide member 62 extends along the scanning direction X, the carriage 71 is supported by the guide member 62 to be capable of moving along the scanning direction X, the discharge heads 40 are supported by the carriage 71 and discharge an ink (a liquid) onto the medium M, and the movement mechanism 61 moves the carriage 71 in the scanning direction X.

The printing unit 6 is provided with drive circuit boards 30, a control circuit board 20, a radiator case 81, and a maintenance unit 91 which are supported by the carriage 71. The radiator case 81 houses each of the drive circuit boards 30 and the control circuit board 20, and the maintenance unit 91 performs the maintenance of each of the discharge heads 40.

The carriage 71 is provided with a carriage main body 72 and a carriage cover 73. The carriage main body 72 has an L-shaped cross section when viewed from the scanning direction X and the carriage cover 73 is attached to the carriage main body 72 to be freely detachable and forms a closed space with the carriage main body 72. The plurality of discharge heads 40 are supported on the bottom portion of the carriage 71 in a state of being lined up equidistantly in the scanning direction X and the bottom end portion of each of the discharge heads 40 protrudes from the bottom surface of the carriage 71 to the outside. A plurality of nozzles 651 from which the ink is discharged is opened in the bottom surface of each of the discharge heads 40 in a lined-up state.

Each of the discharge heads 40 is a so-called ink jet head which includes a pressure generating unit (a piezoelectric element) for discharging the ink for each of the nozzles 651 and the opening of each of the nozzles 651 faces the second support portion 42 in a state in which the discharge heads 40 are supported by the carriage 71. The movement mechanism 61 is provided with a motor and a speed reducer and is a mechanism which converts the rotational force of the motor into motive force of the carriage 71 in the scanning direction X. Therefore, the carriage 71 moves reciprocally in the scanning direction X in a state of supporting the plurality of discharge heads 40, the plurality of drive circuit boards 30, and the control circuit board 20 due to the movement mechanism 61 being driven.

As illustrated in FIGS. 2 and 4, the front end portion of the radiator case 81 which houses each of the drive circuit boards 30 and the control circuit board 20 and has a rectangular parallelepiped shape is fixed to the top end portion of the rear portion of the carriage 71.

The control circuit board 20 (an example of "a second substrate") is supported by the carriage 71 via the radiator case 81. A connector 29 is provided on the control circuit board 20.

The connector 29 is connected to the control unit 2 via a cable 65. In other words, the cable 65 is electrically connected to the control circuit board 20 which is supported by the carriage 71 which moves reciprocally in the scanning direction X and the control unit 2 which is fixed to the liquid discharging apparatus 1. Therefore, it is preferable that the cable 65 be configured as a flexible flat cable (FFC) which deforms following the reciprocal movement of the carriage 71.

The plurality of drive circuit boards 30 is provided above the control circuit board 20 in the vertical direction Z to stand up and to be lined up. The control circuit board 20 and each of the drive circuit boards 30 are connected to each other by a board-to-board (B-to-B) connector 83. The B-to-B connectors 83 will be described in detail later and each is a connector which includes a first connector 83*a* (an example of "a first connector") which is provided on the drive circuit board 30 and a second connector 83*b* (an example of "a second connector") which is provided on the control circuit board 20. The B-to-B connectors 83 are connectors which electrically connect the drive circuit boards 30 and the control circuit board 20 to each other by the first connector 83*a* and the second connector 83*b* being fitted together.

The plurality of drive circuit boards 30 (an example of "a first substrate") is supported by the carriage 71 via the radiator case 81. In detail, the plurality of drive circuit boards 30 is supported by the radiator case 81 in a state in which the drive circuit boards 30 are arranged at an equal interval in the scanning direction X. At this time, the arrangement direction of the plurality of drive circuit boards 30 and the arrangement direction of the plurality of discharge heads 40 are the same. In other words, each of the drive circuit boards 30 and discharge heads 40 correspond to each other and are provided to be lined up in a state of being supported by the carriage 71.

FFC connectors 84 and 85 are provided on the front end portions of each of the drive circuit boards 30. Each of the FFC connectors 84 and 85 is exposed to the carriage 71 from the front surface of the radiator case 81.

One end portion of a cable 86 which is configured by an FFC or the like is connected to the FFC connector 84 to be freely detachable (possible to freely remove and insert) and one end portion of a cable 87 which is configured by an FFC or the like is connected to the FFC connector 85 to be freely detachable.

A connection substrate 74 is connected to the discharge head 40 via a B-to-B connector 75 on the top surface of the discharge head 40. FFC connectors 76 and 77 are provided on the connection substrate 74. The other end portion of the cable 86 is connected to the FFC connector 76 to be freely detachable and the other end portion of the cable 87 is connected to the FFC connector 77 to be freely detachable. Accordingly, each of the drive circuit boards and each of the discharge heads 40 are electrically connected to each other via the cables 86 and 87 and the connection substrate 74.

At this time, the plurality of drive circuit boards 30 is provided to line up on the radiator case 81 and the plurality of discharge heads 40 is provided to correspond to the plurality of drive circuit boards 30 and to line up on the carriage main body 72.

As illustrated in FIGS. 2 and 4, the guide member 62 includes a guide rail portion 63 which extends in the scanning direction X on the bottom portion of the front surface of the guide member 62. The carriage 71 is supported to be capable of moving in the scanning direction X by the guide rail portion 63 on a carriage support portion 64 which is provided on the bottom portion of the rear surface of the carriage 71. In other words, the carriage support portion 64 is connected to the guide rail portion 63 to be capable of sliding in the scanning direction X. In other words, due to the driving of the movement mechanism 61, the carriage 71 moves reciprocally along the scanning direction X while being guided by the guide rail portion 63 of the guide member 62 in the carriage support portion 64.

As illustrated in FIG. 3, the maintenance unit 91 is provided to be adjacent to the second support portion 42 in the scanning direction X. The maintenance unit 91 includes a cap 92 for performing capping which renders the space in which the nozzles 651 are opened a closed space by coming into contact with the discharge heads 40. The capping is performed in order to suppress the drying of the ink inside the nozzles 651 of the discharge heads 40. The capping is an example of the maintenance and the configuration is not limited thereto.

2. Configuration of Discharge Head

Here, a description will be given of the configuration of the discharge head 40 in the present embodiment using FIGS. 5 to 7.

Figure 5:
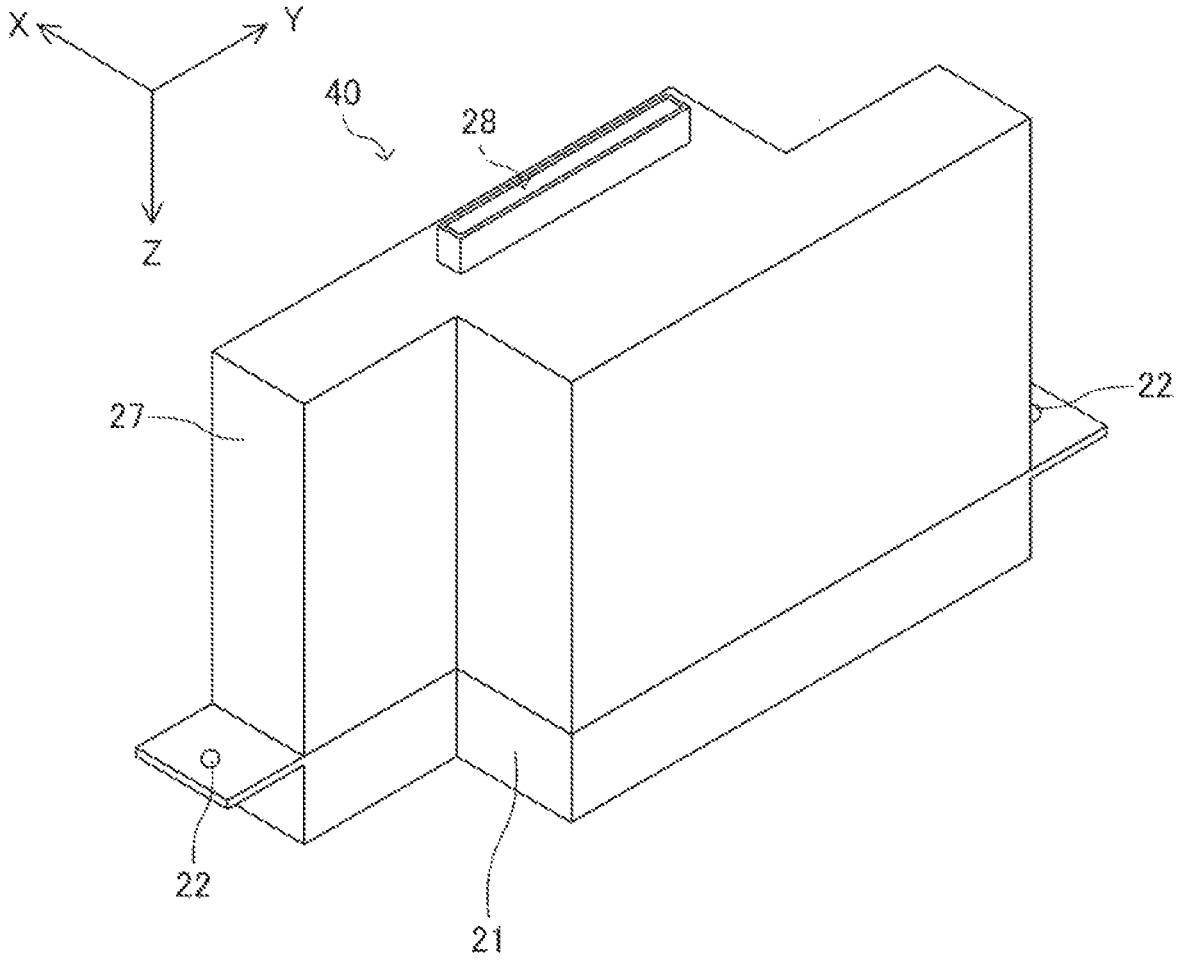
FIG. 5 is a perspective view illustrating a configuration of a discharge head.

FIG. 5 is a perspective diagram of the discharge head 40. As illustrated in FIG. 5, the discharge head 40 is provided with a holder 21 and a cover member 27.

Flange portions 22 are provided on both sides of the holder 21 in the front-rear direction Y to be integral with the holder 21. The flange portions 22 are fixed to the carriage main body 72 (refer to FIG. 2) using screws or the like.

The cover member 27 is provided above (above in FIG. 5) the holder 21 in the vertical direction Z. The cover member 27 covers ink flow paths (not illustrated) which are provided in the inner portion and which introduce the ink to the nozzles 651. An opening 28 through which the B-to-B connector 75 (refer to FIG. 2), which is connected to the connection substrate 74 (refer to FIG. 2), is inserted is provided above the cover member 27 in the vertical direction Z.

Figure 6:
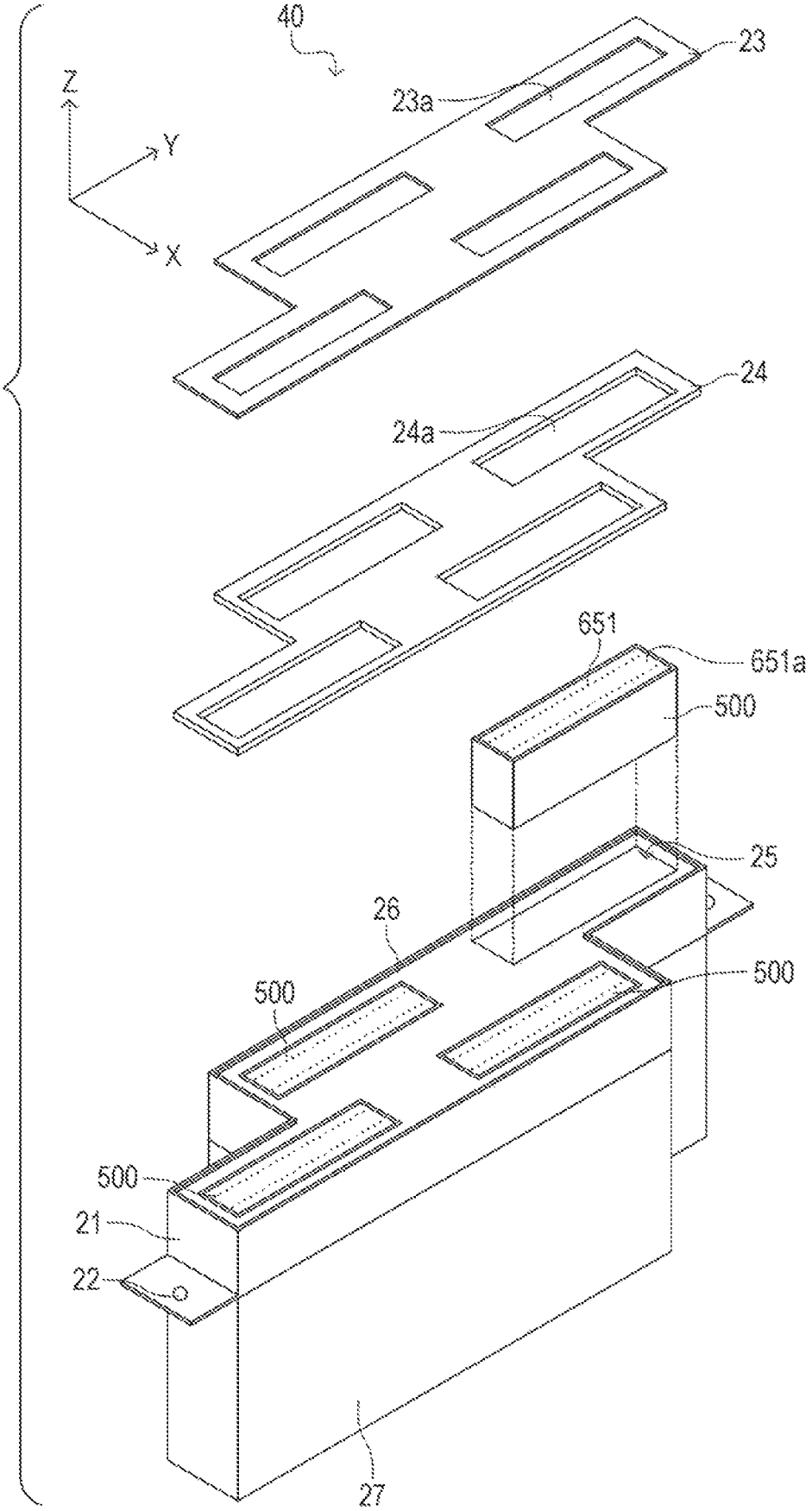
FIG. 6 is an exploded perspective view illustrating the configuration of the discharge head as viewed from beneath in a vertical direction.

FIG. 6 is an exploded perspective view of the discharge head 40 as viewed from beneath in the vertical direction Z (the forming surface of the nozzles 651).

As illustrated in FIG. 6, a fixing plate 23, a reinforcement plate 24, and a plurality of (in the present embodiment, four) discharge modules 500 are provided in the holder 21 of the discharge head 40.

The holder 21 is formed of a conductive material such as a metal, for example, which has a greater strength than the fixing plate 23. A housing portion 25 which houses the plurality of discharge modules 500 is provided on the bottom surface (the top side in FIG. 6) of the holder 21 in the vertical direction Z.

The housing portion 25 includes concave shapes which are open downward in the vertical direction Z and houses the plurality of discharge modules 500 which are fixed by the fixing plate 23. At this time, the openings of the housing portion 25 are sealed by the fixing plate 23. In other words, the discharge modules 500 are housed in the inner portions of the spaces which are formed by the housing portion 25 and the fixing plate 23. The housing portion 25 may be provided for each of the discharge modules 500 and may be provided continuously across the plurality of discharge modules 500.

A recessed portion 26 which has a recessed shape in which the reinforcement plate 24 and the fixing plate 23 are fixed is provided in the surface in which the housing portions 25 of the holder 21 are provided. The reinforcement plate 24 and the fixing plate 23 are sequentially laminated on the base surface of the recessed portion 26.

The fixing plate 23 is formed of a plate-shaped member which is formed of a conductive material such as a metal. The fixing plate 23 is provided with openings 23*a* which penetrate the fixing plate 23 in the vertical direction Z and which expose nozzle surfaces 651*a* which are provided with the nozzles 651 of each of the discharge modules 500. The openings 23*a* are provided independently for each of the discharge modules 500. The fixing plate 23 is fixed to the nozzle surface 651*a* side of the discharge modules 500 at the peripheral edge portion of the openings 23*a*.

It is preferable to use a material with a greater strength than the fixing plate 23 for the reinforcement plate 24. Opening portions 24*a* which have inner diameters larger than the outer circumferences of the discharge modules 500 are provided to penetrate the reinforcement plate 24 in the vertical direction Z in correspondence with the discharge modules 500 which are bonded to the fixing plate 23. The discharge modules 500 which are inserted through the insides of the openings 24*a* of the reinforcement plate 24 are bonded to the fixing plate 23.

The fixing plate 23 and the holder 21 are pressed against each other and are bonded together at a predetermined pressure in a state in which the fixing plate 23 and the holder 21 are supported by a supporting tool (not illustrated).

Figure 7:
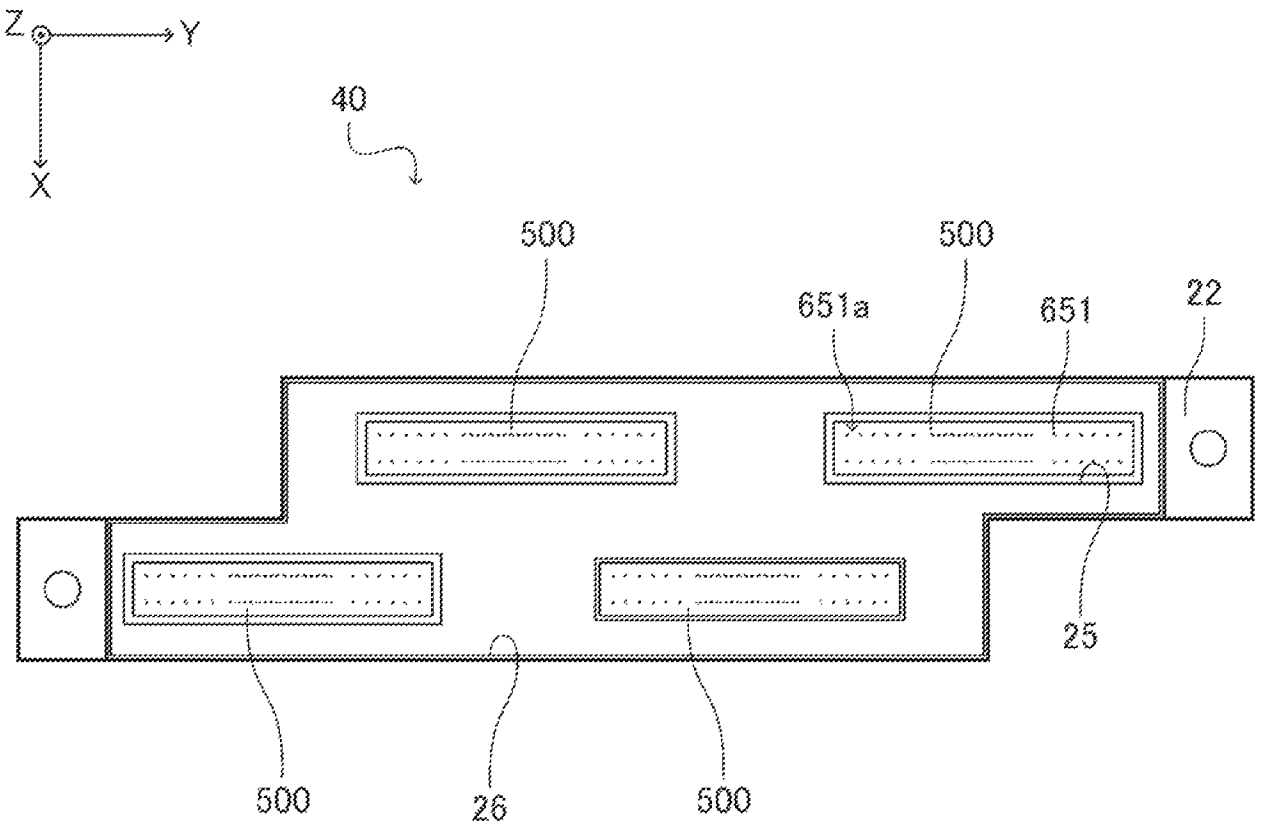
FIG. 7 is a diagram illustrating a nozzle forming surface in which nozzles of the discharge head are formed.

FIG. 7 is a diagram illustrating a nozzle forming surface in which the nozzles 651 of the discharge head 40 are formed.

As illustrated in FIG. 7, the discharge modules 500 are disposed in a staggered shape on the bottom surface of the holder 21 in the vertical direction Z. The nozzles 651 which discharge the ink are provided to line up along the front-rear direction Y in the discharge modules 500. In the discharge module 500, two rows of the nozzles 651 which are provided to line up in the front-rear direction Y are provided in the scanning direction X. Greater than or equal to 300 of the nozzles 651 per inch are provided to line up along the scanning direction X in the discharge modules 500, and greater than or equal to 600 of the nozzles 651 are provided in a single discharge module 500. In other words, the discharge head 40 in the present embodiment is provided with greater than or equal to 2400 of the nozzles 651.

The inner portion of the discharge module 500 is provided with flow paths which communicate with the nozzles 651 and pressure generating units which generate pressure changes in the ink inside the flow paths.

3. Configuration of Discharge Unit

Figure 8:
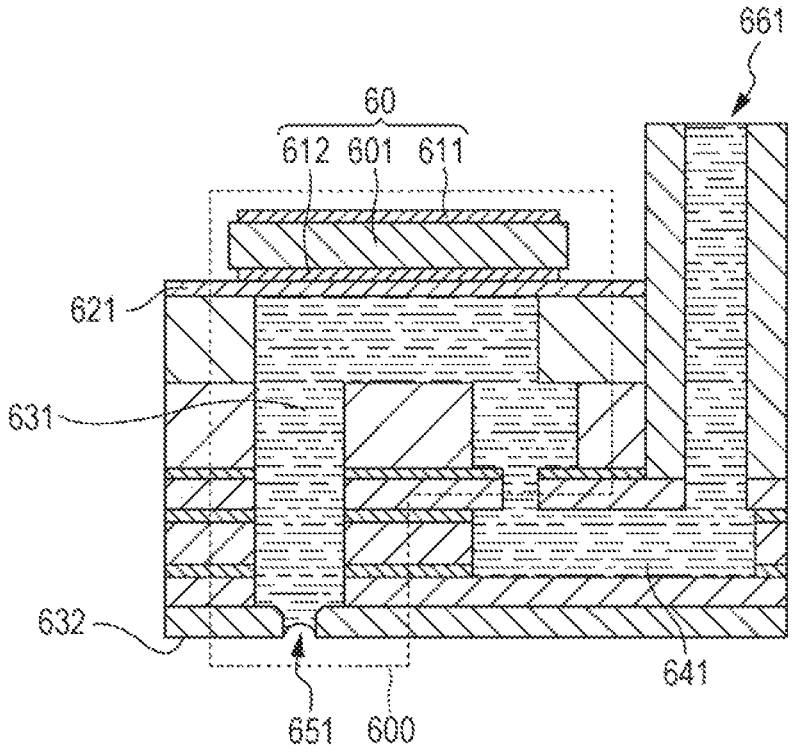
FIG. 8 is a diagram illustrating a schematic configuration of an inside of the discharge unit including the nozzles.

Here, a description will be given of the configuration of the flow paths which communicate with the nozzles 651 and the pressure generating units which generate pressure changes in the ink inside the flow paths which are provided in the discharge module 500 using FIG. 8. FIG. 8 is a diagram illustrating a schematic configuration of one of a plurality of discharge units 600 including the plurality of nozzles 651 which are provided in the discharge module 500. As illustrated in FIG. 8, the discharge module 500 includes the discharge units 600 and a reservoir 641.

The ink is introduced to the reservoir 641 from an ink cartridge (not illustrated) via an ink tube and a supply port 661. The reservoir 641 is provided for each ink color.

The discharge unit 600 includes a piezoelectric element 60, a diaphragm 621, a cavity 631, and the nozzle 651. Among these, the diaphragm 621 is displaced by the piezoelectric element 60 which is provided on the top surface in FIG. 8 and functions as a diaphragm which expands and contracts the internal volume of the cavity 631 which is filled with the ink. The nozzle 651 is an open hole which is provided in a nozzle plate 632 and communicates with the cavity 631. The inner portion of the cavity 631 is filled with the ink and the internal volume is changed by the displacement of the piezoelectric element 60. The nozzle 651 communicates with the cavity 631 and discharges the ink inside the cavity 631 according to a change in the internal volume of the cavity 631.

The piezoelectric element 60 which is illustrated in FIG. 8 functions as a pressure generating unit and has a structure in which a piezoelectric body 601 is interposed between a pair of electrodes 611 and 612. In the piezoelectric body 601 of this structure, corresponding to a voltage that is applied by the electrodes 611 and 612, in FIG. 8, the central portion of the piezoelectric body 601 flexes in the upward or downward direction in relation to both end portions thereof together with the electrodes 611 and 612 and the diaphragm 621. In the present embodiment, the piezoelectric body 601 of the piezoelectric element 60 is configured to have a film thickness of less than or equal to 1 μm.

Specifically, a drive voltage Vout (described later) which is a voltage signal is supplied to the electrode 611 of the piezoelectric element 60 and a voltage VBS (described later) which is a voltage signal of a fixed voltage is supplied to the electrode 612. The piezoelectric element 60 is configured to flex upward when the potential difference between the drive voltage Vout and the voltage VBS is great and to flex downward when the potential difference between the drive voltage Vout and the voltage VBS is small. In other words, the piezoelectric element 60 is displaced by the potential difference between the drive voltage Vout and the voltage VBS.

If the piezoelectric element 60 flexes upward, the internal volume of the cavity 631 expands and the ink is pulled in from the reservoir 641. Meanwhile, if the piezoelectric element 60 flexes downward, the internal volume of the cavity 631 contracts. In this manner, the internal volume of the cavity 631 changes due to the displacement of the piezoelectric element 60. The ink is discharged from the nozzle 651 according to the change in the internal volume.

The piezoelectric element 60 is not limited to the illustrated structure and may have any form which is capable of discharging the ink by causing the piezoelectric element 60 to deform. The piezoelectric element 60 is not limited to bending vibration and may be configured to use so-called longitudinal vibration.

The piezoelectric elements 60 are provided corresponding to the cavities 631 and the nozzles 651 in the discharge module 500.

4. Electrical Configuration of Liquid Discharging Apparatus

Figure 9:
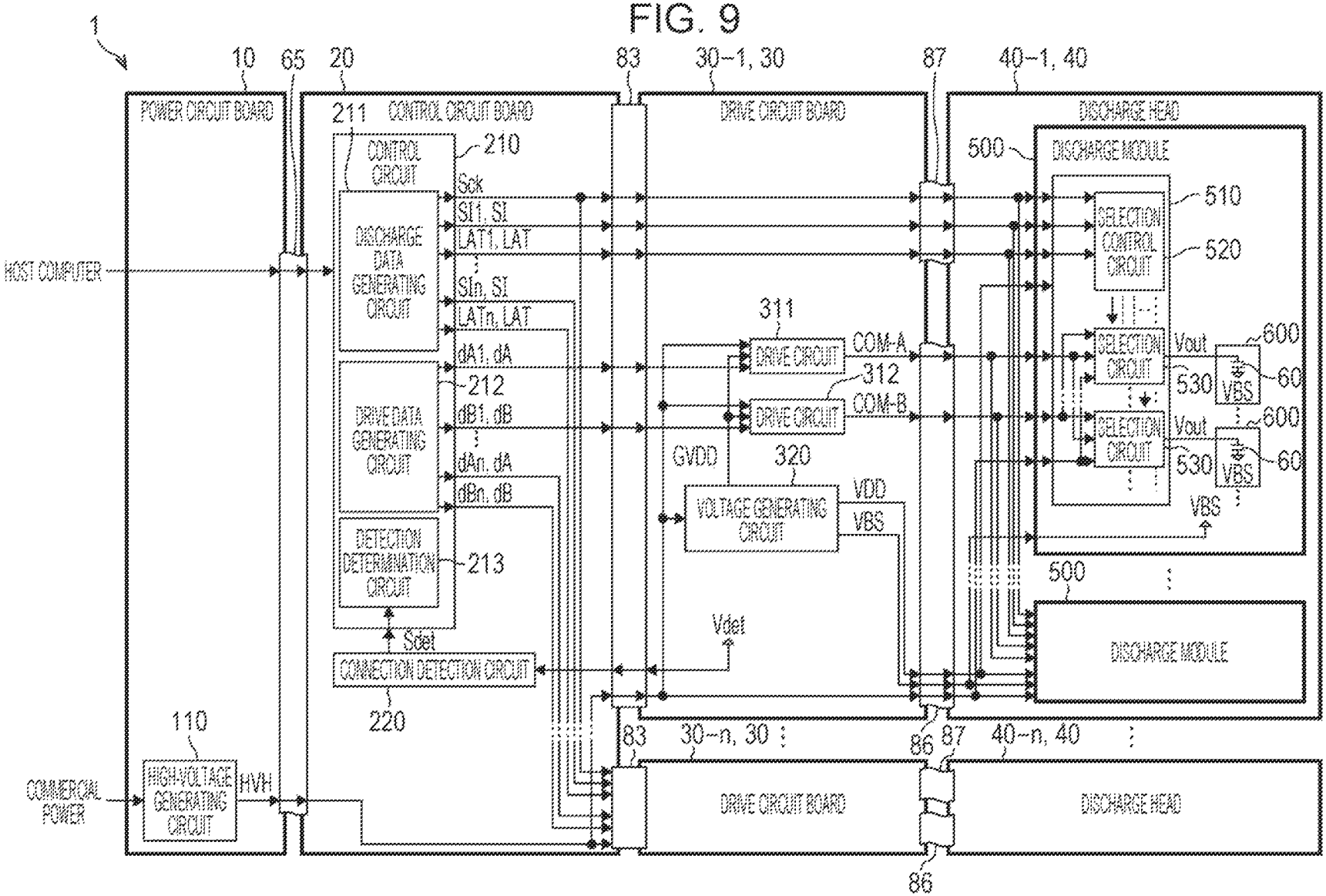
FIG. 9 is a diagram illustrating an electrical configuration of the liquid discharging apparatus.

A description will be given of the electrical configuration of the liquid discharging apparatus 1 in the present embodiment using FIG. 9. FIG. 9 is a block diagram illustrating the electrical configuration of the liquid discharging apparatus 1. As illustrated in FIG. 9, the liquid discharging apparatus 1 is provided with a power circuit board 10, the control circuit board 20, a plurality of drive circuit boards 30-1 to **30-*n*, and a plurality of discharge heads 40-1 and 40-*n*. Here, in the liquid discharging apparatus 1 in the present embodiment, as described earlier, the control circuit board 20, the plurality of drive circuit boards 30-1 to 30-*n*, and the plurality of discharge heads 40-1 to 40-*n* are supported by the carriage 71**.

In a case in which all of the plurality of drive circuit boards 30-1 to **30-*n* are provided with the same configuration and it is not necessary to distinguish one from another, the drive circuit board 30 will be referred to. In a case in which all of the plurality of discharge heads 40-1 to 40-*n* have the same configuration and it is not necessary to distinguish one from another, the discharge head 40 will be referred to. In the present embodiment, the drive circuit board 30-*i* (i=1 to n) and the discharge head 40-*i*** are provided to correspond to each other.

A high-voltage generating circuit 110 is provided on the power circuit board 10. The power circuit board 10 is electrically connected to the control circuit board 20 via the cable 65.

The high-voltage generating circuit 110 generates a voltage HVH which is a voltage signal of DC 42 V, for example, which is used in the liquid discharging apparatus 1 based on the power voltage (for example, AC 100 V which is commercial power) which is input from outside of the liquid discharging apparatus 1 and outputs the voltage HVH to the control circuit board 20.

The power circuit board 10 transmits a signal which is input from a host computer which is outside of the liquid discharging apparatus 1 to the control circuit board 20. The power circuit board 10 is fixed to the liquid discharging apparatus 1 together with the control unit 2 (refer to FIG. 1).

A control circuit 210 and a connection detection circuit 220 are provided on the control circuit board 20 and are electrically connected to the drive circuit board 30 via the B-to-B connector 83.

The control circuit 210 includes a discharge data generating circuit 211 and a drive data generating circuit 212 and when various signals such as image data are supplied from the host computer via the power circuit board 10, the control circuit 210 outputs various control signals and the like for controlling the drive circuit board 30 and the discharge head 40.

Specifically, a portion of the signals which are input to the control circuit 210 is input to the discharge data generating circuit 211. The discharge data generating circuit 211 generates a plurality of types of control signal which controls the discharging of the ink from the discharge units 600 based on the signals which are input.

Specifically, the discharge data generating circuit 211 generates a plurality of (n) print data signals SI1 to SIn for controlling which of a drive voltage COM-A and a drive voltage COM-B (described later) to select and a plurality of (n) latch signals LAT1 to LATn for controlling the period at which the ink is to be discharged from the discharge units 600 and outputs the print data signals SI1 to SIn and the latch signals LAT1 to LATn to each of the plurality of (n) drive circuit boards 30-1 to **30-*n*. At this time, a print data signal SIi and a latch signal LATi are input to the drive circuit board 30-*i*. The signals for controlling the discharging which are input to the drive circuit board 30** are referred to as the print data signal SI and the latch signal LAT.

The discharge data generating circuit 211 outputs a clock signal Sck in common to the plurality of drive circuit boards 30-1 to **30-*n***.

A portion of the signals which are input to the control circuit 210 is input to the drive data generating circuit 212. The drive data generating circuit 212 generates 2n items of drive data dA1 to dAn and dB1 to dBn which is the digital data which serves as the basis of the drive voltages which drive the discharge units 600 based on the signals which are input and outputs the 2n items of drive data dA1 to dAn and dB1 to dBn to each of the n drive circuit boards 30-1 to **30-*n*. At this time, drive data dAi and dBi are input to the drive circuit board 30-*i*. The digital data which serve as the basis of the drive voltages which are input to the drive circuit board 30** are referred to as the drive data dA and dB.

Here, the drive data dA1 to dAn and dB1 to dBn may be digital data which is obtained by subjecting drive voltage waveforms (drive waveforms) to analog-digital conversion, may be digital data indicating the difference with respect to a recent item of drive data, and may be digital data which defines the correspondence relationship between the lengths and each of the inclinations of each section having a fixed inclination in the drive waveform.

The control circuit 210 includes a detection determination circuit 213.

The detection determination circuit 213 performs a determination of whether or not the control circuit board 20 and the drive circuit board 30 are correctly connected to each other via the B-to-B connector 83 based on a detection signal Sdet which is input from the connection detection circuit 220.

The connection detection circuit 220 (an example of "a detection circuit") performs the detection of whether the control circuit board 20 and the drive circuit board 30 are correctly connected to each other via the B-to-B connector 83 based on a voltage Vdet which is the voltage signal which is input. In other words, the connection detection circuit 220 detects the connection between the first connector **83*a* and the second connector 83*b***. The voltage Vdet may be a voltage signal having a fixed voltage value and may be a voltage signal having a reference potential (ground potential).

In a case in which the connection between the first connector **83*a* and the second connector 83*b* is performed based on the voltage signals which are transmitted by a plurality of detection terminals (refer to FIG. 12), a plurality of the connection detection circuits 220 may be provided corresponding to the number of detection terminals. The operation of the connection detection circuit 220 and the detection of the connection between the control circuit board 20 and the drive circuit board 30 which are connected via the B-to-B connector 83** will be described later in detail.

The control circuit board 20 includes a wiring pattern which branches the voltage HVH which is generated by the high-voltage generating circuit 110 and outputs the branched voltage HVH to the plurality of drive circuit boards 30-1 to **30-*n*. In other words, the control circuit board 20** also functions as a relay substrate which branches and transfers the voltage HVH.

Here, the control circuit 210 which is provided in the control circuit board 20 may be provided on the power circuit board 10. Specifically, a configuration may be adopted in which the print data signals SI1 to SIn, the latch signals LAT1 to LATn, and the drive data dA1 to dAn and dB1 to dBn which are generated by the control circuit 210 are input to the control circuit board 20 via the cable 65. At this time, a configuration may be adopted in which the detection signal Sdet is input to the connection detection circuit 220 of the control circuit 210 which is provided on the power circuit board 10 via the cable 65.

The signal which is transferred from the power circuit board 10 to the control circuit board 20 via the cable 65 may be a differential signal in which a serial control signal is used in a low voltage differential signaling (LVDS) transfer system, a low voltage positive emitter coupled logic (LVPECL) transfer system, a current mode logic (CML) transfer system, or the like. At this time, a conversion circuit for converting the various signals which are transferred to the control circuit board 20 into the differential signals is provided on the power circuit board 10 and a restoration circuit for restoring the differential signal which is input is provided on the control circuit board 20.

Drive circuits 311 and 312 and a voltage generating circuit 320 are provided on the drive circuit board 30 and are electrically connected to the discharge head 40 via the cables 86 and 87.

The drive data dA and the voltage HVH are input to the drive circuit 311. The drive circuit 311 generates the drive voltage COM-A (an example of "a drive signal") which is a voltage signal based on the drive data dA and the voltage HVH which are input and outputs the drive voltage COM-A to the discharge head 40.

The drive data dB and the voltage HVH are input to the drive circuit 312. The drive circuit 312 generates the drive voltage COM-B which is a voltage signal based on the drive data dB and the voltage HVH which are input and outputs the drive voltage COM-B to the discharge head 40.

Here, the drive circuits 311 and 312 may differ only in the input data and the output drive voltage and have the same circuit configuration.

For example, if the drive data dA and dB are items of digital data which are obtained by subjecting the waveforms of the drive voltages COM-A and COM-B to analog-digital conversion, respectively, the drive circuits 311 and 312 subject the items of drive data dA and dB to digital-analog conversion, respectively, and subsequently subject the results of the conversion to D class amplification based on the voltage HVH to generate the drive voltages COM-A and COM-B.

For example, if the drive data dA and dB are items of digital data which define the correspondence relationship between the lengths and the respective inclinations of each section of the waveforms of the drive voltages COM-A and COM-B in which the inclination of the waveform is fixed, the drive circuits 311 and 312 generate analog signals which satisfy the correspondence relationships between the lengths and the inclinations of each section which is defined by the drive data dA and dB to digital-analog conversion, respectively, and subsequently subject the analog signals to D class amplification based on the voltage HVH to generate the drive voltages COM-A and COM-B.

The voltage generating circuit 320 generates a plurality of voltage signals which have a plurality of voltage values based on the voltage HVH.

Specifically, the voltage generating circuit 320 generates the voltage VBS (for example, DC 6V) which is supplied to the piezoelectric elements 60 which are provided in the discharge head 40 as a voltage signal and outputs the voltage VBS to the discharge head 40. The plurality of voltage generating circuits 320 each generates a voltage VDD (for example, DC 3.3 V) which supplies the power voltage of various constituent elements which are provided in the discharge head 40 as a voltage signal and outputs the voltage VDD to the discharge head 40. The plurality of voltage generating circuits 320 each generates a voltage GVDD (for example, DC 7.5 V) for driving an amplifier which is included in D class amplification circuits which are provided in the drive circuits 311 and 312 as a voltage signal and outputs the voltage GVDD to the drive circuits 311 and 312. The plurality of voltage generating circuits 320 may generate a plurality of voltage signals other than those that are described above.

The drive circuit board 30 transfers the print data signal SI, the latch signal LAT, and the clock signal Sck which are input from the discharge data generating circuit 211 to the discharge head 40.

Here, as described earlier, the drive circuit board 30 and the discharge head 40 are electrically connected to each other by the cable 86 and the cable 87. Of the cables, the cable 86 transfers the drive voltages COM-A and COM-B and the voltages VDD and VBS from the drive circuit board 30 to the discharge head 40 and the cable 86 transfers the print data signal SI, the latch signal LAT, and the clock signal Sck.

As described above, by providing the cable 87 which transfers the print data signal SI, the latch signal LAT, and the clock signal Sck based on a voltage of several mV and the cable 86 which transfers the drive voltages COM-A and COM-B and the voltages VDD and VBS which are voltage signals of greater than or equal to several V, it is possible to reduce the interference between the mutual signals.

The discharge head 40 is provided with the plurality of discharge modules 500.

Each of the plurality of discharge modules 500 is provided with a drive signal selection circuit 510 and the plurality of discharge units 600.

The drive signal selection circuit 510 is provided with a selection control circuit 520 and a plurality of selection circuits 530. The drive signal selection circuit 510 is configured by an integrated circuit (IC), for example, and is operated by the voltage VDD.

The selection control circuit 520 receives input of the print data signal SI, the latch signal LAT, and the clock signal Sck.

The selection control circuit 520 generates the selection signal for controlling whether to select the drive voltage COM-A or the drive voltage COM-B (or whether to select neither) with respect to the each of the plurality of selection circuits 530 based on the print data signal SI and outputs the selection signal based on a printing period which is defined by the latch signal LAT.

Each of the selection circuits 530 receives input of the drive voltages COM-A and COM-B which are generated by the drive circuits 311 and 312. The selection circuit selects one of the drive voltages COM-A and COM-B which is input according to the selection signal which is output from the selection control circuit 520 and outputs the selected drive voltage to the corresponding discharge unit 600 as the drive voltage Vout. The drive voltage Vout is applied to one end of the piezoelectric element 60.

At this time, the voltage HVH is also input to the selection circuit 530. The selection circuit 530 selects the high-voltage drive voltage COM-A or COM-B which is amplified based on the voltage HVH in the drive circuits 311 and 312 and outputs the selected drive voltage as the drive voltage Vout. Therefore, the selection circuit 530 is capable of more reliably performing the selection of the drive voltage COM-A or the drive voltage COM-B by controlling which of the drive voltages COM-A and COM-B to select using the voltage HVH.

As described above, the drive signal selection circuit 510 selects the drive voltages COM-A and the drive voltages COM-B which are input and supplies the selected drive voltages to the piezoelectric element 60 as the drive voltages Vout. In other words, the drive signal selection circuit 510 controls the supply of the drive voltages COM-A and COM-B to the piezoelectric elements 60.

Each of the plurality of discharge units 600 includes the piezoelectric element 60 and is provided corresponding to each of the selection circuits 530. The drive voltage Vout which is output from the selection circuit 530 is applied to one end of the piezoelectric element 60 and the voltage VBS is applied to the other end. The piezoelectric element 60 is displaced by the potential difference between the drive voltage Vout and the voltage VBS and causes the ink to be discharged from the discharge unit 600 (the nozzle 651) based on the displacement.

5. Connection Detection of B-to-B Connector 5.1 Outline of B-to-B Connector

Figure 10:
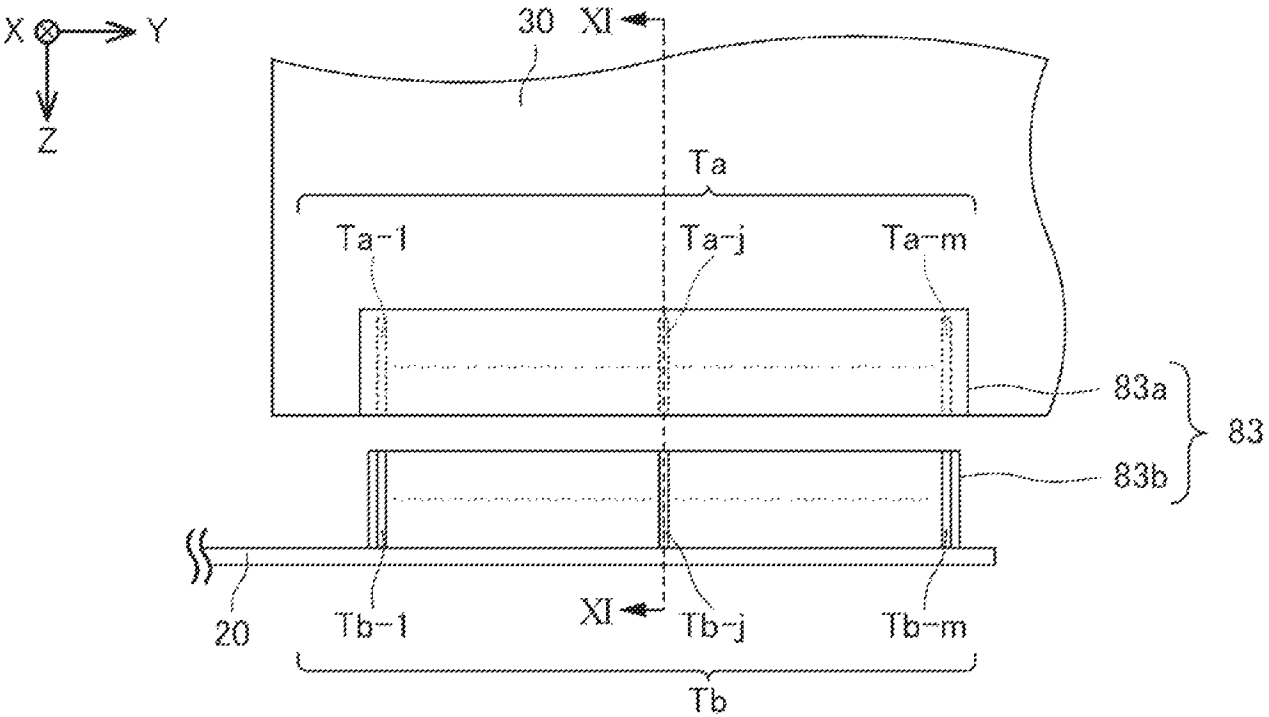
FIG. 10 is a diagram for describing a configuration of a B-to-B connector.
Figure 11:
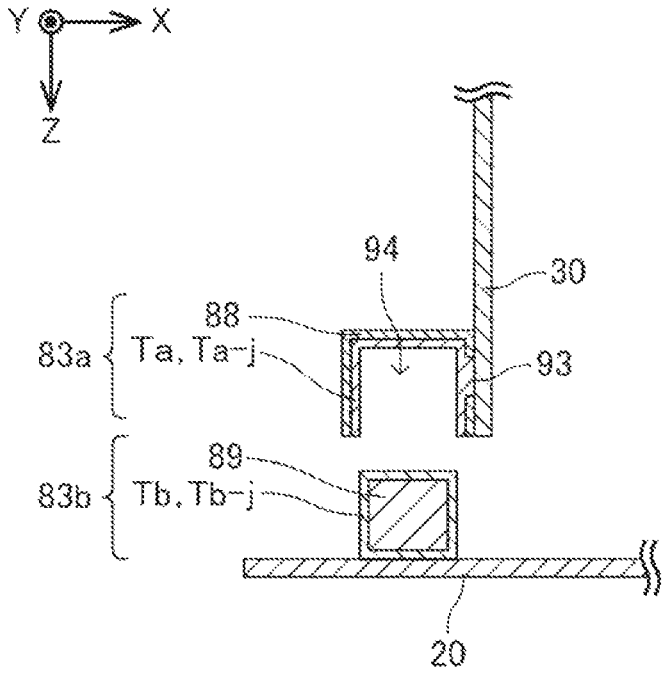
FIG. 11 is a diagram illustrating a cross section taken along a line XI-XI in FIG. 10.

Here, a description will be given of the B-to-B connector 83 which connect the control circuit board 20 and the drive circuit board 30 to each other using FIGS. 10 and 11. FIG. 10 is a diagram for describing the configuration of the B-to-B connector 83 which connects the control circuit board 20 and the drive circuit board 30 to each other. FIG. 11 is a diagram illustrating a cross section taken along a line XI-XI in FIG. 10.

As illustrated in FIG. 10, the B-to-B connector 83 includes the first connector 83*a* which is provided on the drive circuit board 30 and the second connector 83*b* which is provided on the control circuit board 20. The control circuit board 20 and the drive circuit board 30 are electrically connected to each other by fitting the first connector 84*a* and the second connector 84*b* to each other.

Specifically, m terminals Ta (an example of "a plurality of first terminals") are provided to line up on the first connector 83*a*. In other words, a terminal row (an example of "a first terminal row") in which terminals Ta-1 to Ta-m are provided to line up in order along the front-rear direction Y is formed on the first connector 83*a*. Additionally, m terminals Tb (an example of "a plurality of second terminals") are provided to line up on the second connector 83*b*. In other words, a terminal row (an example of "a second terminal row") in which terminals Tb-1 to Tb-m are provided to line up in order along the front-rear direction Y is formed on the second connector 83*b*.

When the first connector 84*a* and the second connector 84*b* are fitted together, the first connector 83*a* and the second connector 84*b* are electrically connected to each other by a j-th terminal Ta-j (j=1 to m) which is provided to line up on the first connector 84*a* and a j-th terminal Tb-j which is provided to line up on the second connector 84*b* contacting each other. Accordingly, the control circuit board 20 and the drive circuit board 30 are electrically connected to each other.

More specifically, as illustrated in FIG. 11, the first connector 84*a* includes a housing 88 which is formed of a resin or the like. The housing 88 has a recessed shape including an opening portion 94 on the bottom in vertical direction Z in FIG. 11. The terminals Ta are provided along the inner wall surface of the opening portion 94. At this time, the terminals Ta are in contact with the drive circuit board 30 via a through hole 93 which is provided in the housing 88. On the surface on which the terminals Ta and the drive circuit board 30 are in contact, the terminals Ta and the wiring pattern (the electrodes) which is provided on the drive circuit board 30 are electrically connected to each other, and so the first connector 84*a* is electrically connected to the drive circuit board 30.

The second connector 84*b* includes a housing 89 which is formed of a resin or the like. The terminal Tb is provided to surround the periphery of the housing 89. At this time, on the surface on which the terminals Tb and the control circuit board 20 are in contact, the terminals Tb and the wiring pattern (the electrodes) which is provided on the control circuit board 20 are electrically connected to each other. Therefore, the second connector 84*b* is electrically connected to the control circuit board 20.

Due to the second connector 84*b* being fitted into the opening portion 94 which is provided in the first connector 83*a*, the terminal Ta-j and the terminal Tb-j are electrically connected to (in contact with) each other. Accordingly, the control circuit board 20 and the drive circuit board 30 are electrically connected to each other.

As described above, the drive circuit board 30 and the control circuit board 20 are electrically connected to each other by m terminals Ta (the terminals Ta-1 to Ta-m) which are included on the first connector 84*a* which is provided on the drive circuit board 30 and m terminals Tb (the terminals Tb-1 to Tb-m) which are included on the second connector 84*b* which is provided on the control circuit board 20 being electrically connected to each other, respectively.

5.2 Detection of Connection Fault of B-to-B Connector

In a case in which the drive circuit board 30 and the control circuit board 20 are electrically connected to each other using the B-to-B connector 83, for example, when the fitting between the first connector 84*a* and the second connector 84*b* is insufficient and when the first connector 84*a* and the second connector 84*b* are obliquely fitted together, there is a concern that the connection between the terminals Ta-j and Tb-j becomes insufficient and that connection faults will arise between the drive circuit board 30 and the control circuit board 20.

Therefore, in the present embodiment, the first connector 84*a* and the second connector 84*b* include connection detection terminals, and further, reduce the concern of connection faults arising between the drive circuit board 30 and the control circuit board 20 by detecting the connection between the drive circuit board 30 and the control circuit board 20 based on the signal which is propagated by the detection terminals.

Figure 12:
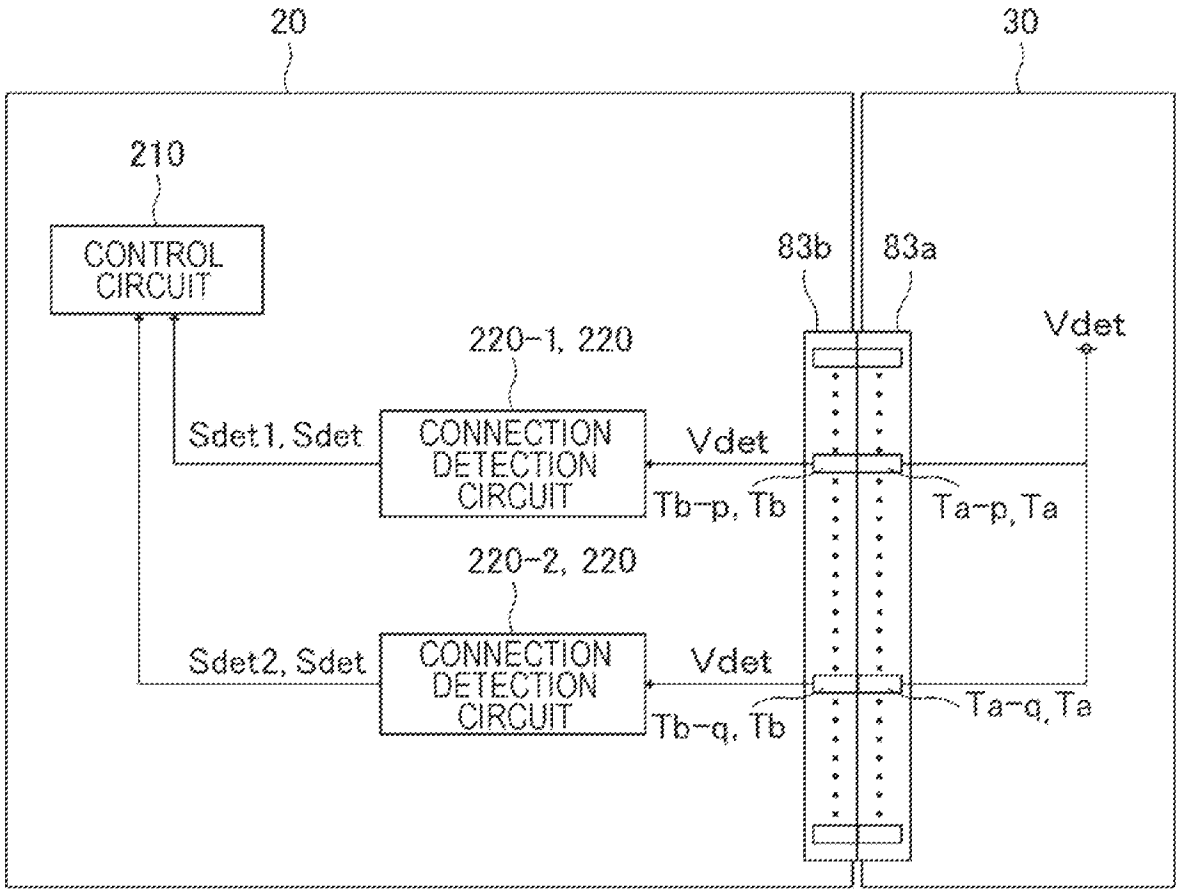
FIG. 12 is a diagram for describing the operations when the B-to-B connector is correctly connected.
Figure 13:
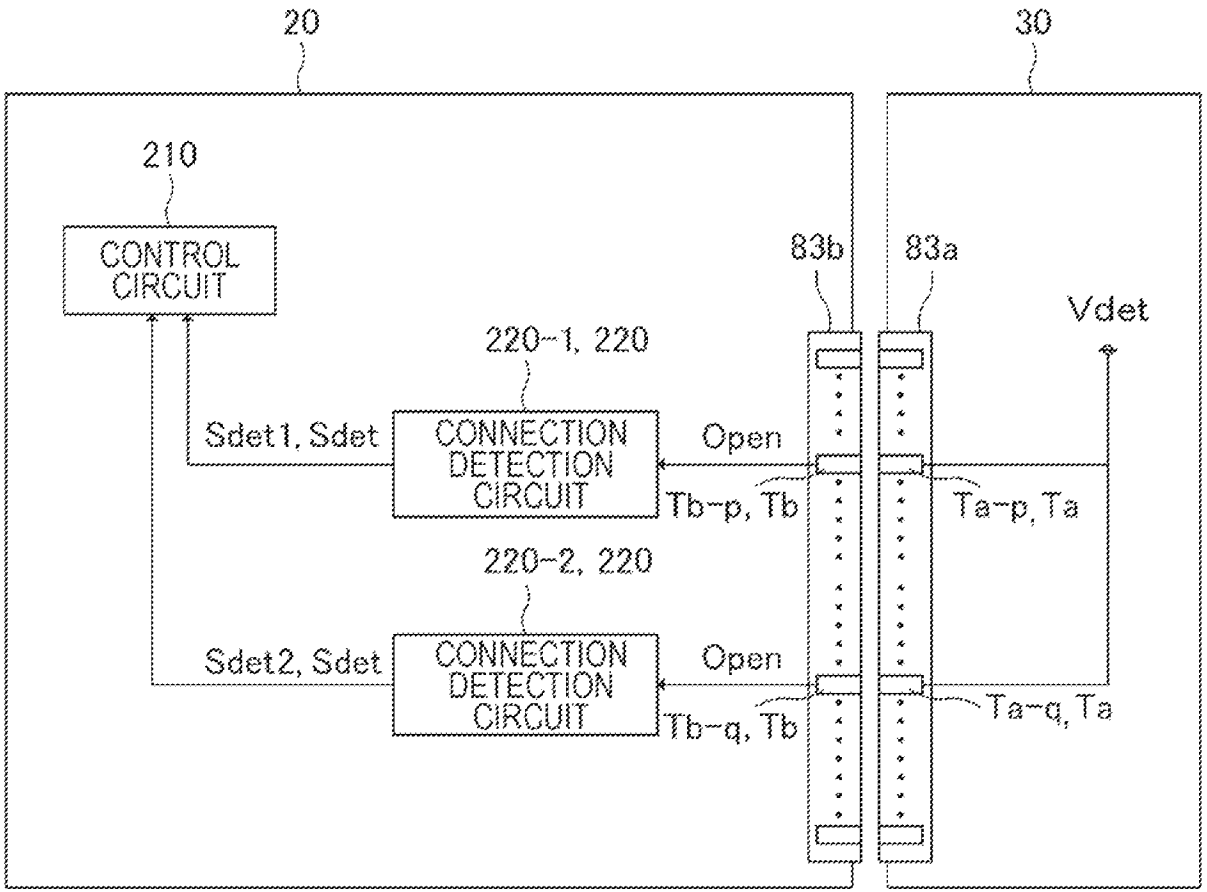
FIG. 13 is a diagram for describing the operations when the B-to-B connector is not correctly connected.

Specifically, as illustrated in FIGS. 12 and 13, the first connector 84*a* uses one of the m terminals Ta (refer to FIG. 10) as the connection detection terminal Ta-p (p=one of 1 to m) and uses another one of the m terminals Ta as the other connection detection terminal Ta-q (q=one of 1 to m and is in a relationship of p≠q).

The second connector 84*b* uses one of the m terminals Tb (refer to FIG. 10) as the connection detection terminal Tb-p and uses another one of the m terminals Tb as the other connection detection terminal Tb-q.

When the first connector 84*a* and the second connector 84*b* are correctly fitted together, the connection detection terminal Ta-p and the terminal Tb-p are electrically connected to each other, and further, the connection detection terminal Ta-q and the terminal Tb-q are electrically connected to each other.

The terminal Tb-p is connected to a connection detection circuit 220-1. Accordingly, when the first connector 84*a* and the second connector 84*b* are correctly fitted together, the voltage signal which is propagated by the terminal Ta-p and the terminal Tb-p is input to the connection detection circuit 220-1. The connection detection circuit 220-1 detects the connection between the drive circuit board 30 and the control circuit board 20 based on the voltage signal which is input.

The terminal Tb-q is connected to a connection detection circuit 220-2. Accordingly, when the first connector 84*a* and the second connector 84*b* are correctly fitted together, the voltage signal which is propagated by the terminal Ta-q and the terminal Tb-q is input to the connection detection circuit 220-2. The connection detection circuit 220-2 detects the connection between the drive circuit board 30 and the control circuit board 20 based on the voltage signal which is input.

In more detail, as illustrated in FIG. 12, when the B-to-B connector 83 (the first connector 84*a* and the second connector 83*b*) is correctly connected, the terminal Ta-p and the terminal Tb-p are electrically connected. Therefore, the voltage Vdet which is a voltage signal is input to the connection detection circuit 220-1 (the connection detection circuit 220, an example of "a detection circuit") which is provided on the control circuit board 20 via the terminal Ta-p and the terminal Tb-p.

Meanwhile, as illustrated in FIG. 13, when the first connector 84*a* and the second connector 84*b* are correctly connected to each other, the terminal Ta-p and the terminal Tb-p are electrically connected. Therefore, a voltage signal based on the voltage Vdet is not input to the connection detection circuit 220-1.

The connection detection circuit 220-1 detects whether or not the voltage signal which is input is a voltage signal based on the voltage Vdet. The connection detection circuit 220-1 outputs a detection signal Sdet1 (the detection signal Sdet) to the detection determination circuit 213 as a signal indicating the result of the detection.

Similarly, when the B-to-B connector 83 (the first connector 84*a* and the second connector 83*b*) is correctly connected, the terminal Ta-q and the terminal Tb-q are electrically connected. Therefore, the voltage Vdet which is a voltage signal is input to the connection detection circuit 220-2 (the connection detection circuit 220) which is provided on the control circuit board 20 via the terminal Ta-q and the terminal Tb-q.

Meanwhile, as illustrated in FIG. 13, when the first connector 84*a* and the second connector 84*b* are correctly connected to each other, the terminal Ta-q and the terminal Tb-q are electrically connected. Therefore, a voltage signal based on the voltage Vdet is not input to the connection detection circuit 220-2.

The connection detection circuit 220-2 detects whether or not the voltage signal which is input is a voltage signal based on the voltage Vdet and outputs a signal indicating the result of the detection as a detection signal Sdet2 (the detection signal Sdet) to the detection determination circuit 213.

When at least one of the detection signals Sdet (the detection signals Sdet1 and Sdet2) which are input from the connection detection circuits 220-1 and 220-2 is a signal indicating that the B-to-B connector 83 is not correctly connected, the detection determination circuit 213 determines that the drive circuit board 30 and the control circuit board 20 are not correctly connected to each other.

When the detection determination circuit 213 determines that the drive circuit board 30 and the control circuit board 20 are not correctly connected to each other, the detection determination circuit 213 may output a signal for stopping the operation of the liquid discharging apparatus 1 and the detection determination circuit 213 may output a signal for performing notification of the fact that the B-to-B connector 83 is not correctly connected to a notification unit or the like (not illustrated).

In the present embodiment, for the connection detection terminals of the B-to-B connector 83, two sets (four) of the terminals Ta-p and Tb-p and the terminals Ta-q and Tb-q which are electrically connected are used as the connection detection terminals. However, a set of the terminals Ta-p and Tb-p or a set of the terminals Ta-q and Tb-q may be used, and three or more sets of detection terminals may be provided.

In the present embodiment, the B-to-B connector 83 includes two sets of terminals, the terminals Ta-p and Tb-p and the terminals Ta-q and Tb-q, as the connection detection terminals. Therefore, in the present embodiment, although a description is given in which the two connection detection circuits 220 (the connection detection circuits 220-1 and 220-2) are provided on the control circuit board 20 corresponding to each of the two sets of detection terminals, the configuration is not limited thereto.

Here, it is preferable that at least one of the terminal Ta-p and the terminal Ta-q which are the connection detection terminals which are provided on the first connector 84*a* be provided on one end portion side in the terminal row which is formed by the m terminals Ta being provided to line up. It is preferable that the terminal Ta-p and the terminal Ta-q be provided on both end portion sides in the terminal row which is formed by the m terminals Ta being provided to line up.

Similarly, it is preferable that at least one of the terminal Tb-p and the terminal Tb-q which are the connection detection terminals which are provided on the second connector 84*b* be provided on one end portion side in the terminal row which is formed by the m terminals Tb being provided to line up. It is preferable that the terminal Tb-p and the terminal Tb-q be provided on both end portion sides in the terminal row which is formed by the m terminals Tb being provided to line up.

Here, "the end portion side" in the one end portion side and both end portion sides is not limited to the endmost portions in the terminal row.

Specifically, a terminal which is provided on the one end portion side means a terminal which is provided in a range of 20% with respect to the total number of terminals Ta (the terminals Tb) from one endmost portion of the terminal row in the terminal row which is formed by the terminals Ta (the terminals Tb) being provided to line up. Terminal which are provided on both end portion sides means terminals which are provided in a range of 20% with respect to the total number of terminals Ta (the terminals Tb) from both endmost portions of the terminal row in the terminal row which is formed by the terminals Ta (the terminals Tb) being provided to line up, for example.

Figure 14:
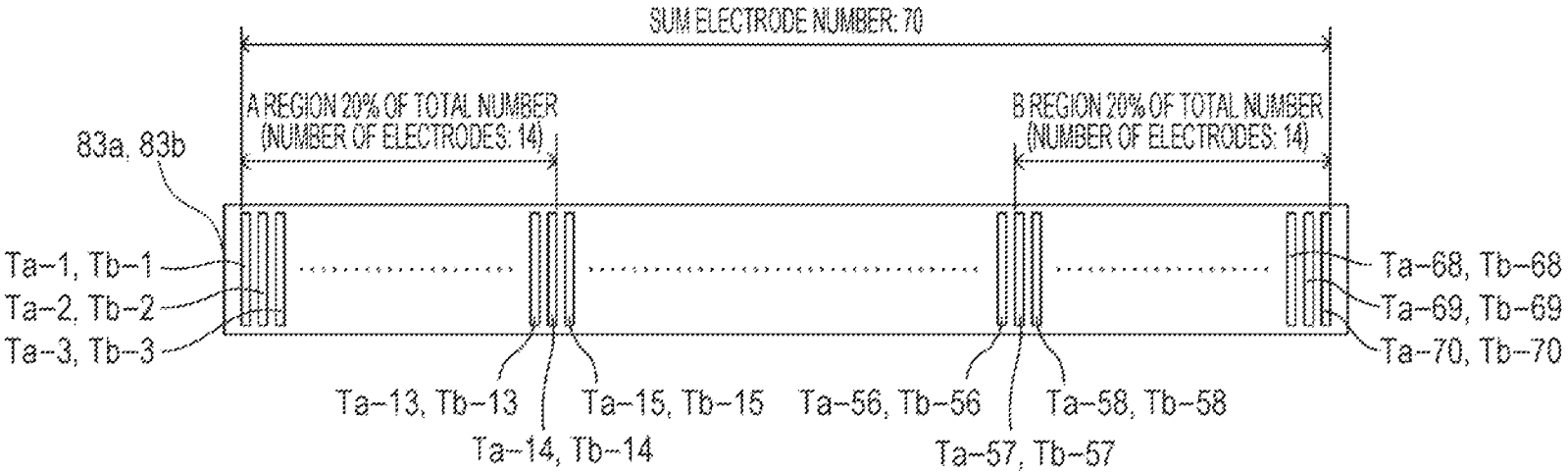
FIG. 14 is a diagram for describing an end portion side of a plurality of terminals which are provided to line up on the B-to-B connector.

In detail, as illustrated in FIG. 14, in the first connector 83*a*, for example, 70 of the terminals Ta are provided to line up in the order of the terminal Ta-1, Ta-2, . . . , Ta-69, and Ta-70. In this case, it is preferable that the terminal Ta-p be one of the terminals of the 14 terminals (the terminals which are included in an A region in FIG. 14) among the terminals Ta-1 to Ta-14 which are provided in the range of 20% of the total number 70 on the one end portion side. It is preferable that the terminal Ta-q be one of the terminals of the 14 terminals (the terminals which are included in a B region in FIG. 14) among the terminals Ta-57 to Ta-70 which are provided in the range of 20% of the total number 70 on the other end portion side.

Similarly, in the second connector 83*b*, for example, 70 of the terminals Tb are provided to line up in the order of the terminal Tb-1, Tb-2, . . . , Tb-69, and Tb-70. In this case, it is preferable that the terminal Tb-p be one of the terminals of the 14 terminals (the terminals which are included in an A region in FIG. 14) among the terminals Tb-1 to Tb-14 which are provided in the range of 20% of the total number 70 on the one end portion side. It is preferable that the terminal Tb-q be one of the terminals of the 14 terminals (the terminals which are included in a B region in FIG. 14) among the terminals Tb-57 to Tb-70 which are provided in the range of 20% of the total number 70 on the other end portion side.

In the B-to-B connector 83, when a connection fault caused by the first connector 84*a* and the second connector 84*b* being fitted together in a slanted state arises, the connection fault originating in the slanting appears notably at the end portions of the first connector 84*a* and the second connector 83*b*.

Therefore, by providing the connection detection terminals Ta-p, Tb-p, Ta-q, and Tb-q on the end portion sides of the terminal rows which are provided on the first connector 84*a* and the second connector 83*b*, it is possible to further improve the detection precision of the connection fault between the first connector 84*a* and the second connector 83*b*.

As described earlier, the liquid discharging apparatus 1 in the present embodiment is provided with the discharge heads 40 which are provided with the many (greater than or equal to 2400) nozzles 651, and the drive circuit boards 30 which are provided with the drive circuits 311 and 312 which generate the drive voltages COM-A and COM-B for driving the nozzles 651.

Therefore, many signals for driving the many nozzles 651 which are provided in the discharge head 40 are input to the drive circuit board 30. Therefore, there is a demand to provide many terminals, and further, that the terminals be provided at high density in the B-to-B connector 83 which connects the control circuit board 20 and the drive circuit board 30 to each other and transfers the many signals from the control circuit board 20 to the drive circuit board 30.

Even in the B-to-B connector 83 in which many terminals are provided at high density, it is possible to reduce the concern of connection faults arising between the control circuit board 20 and the drive circuit board 30 by providing the connection detection terminals Ta-p, Tb-p, Ta-q, and Tb-q on the first connector 84*a* and the second connector 83*b*.

Since the concern of connection faults between the control circuit board 20 and the drive circuit board 30 occurring is reduced, even in the liquid discharging apparatus 1 in which the plurality of drive circuit boards is connected to the control circuit board 20 and the discharge heads 40 are provided corresponding to each of the plurality of drive circuit boards 30, the concern the connection faults arising between the control circuit board 20 and the individual drive circuit boards 30 is reduced and it is possible to increase the reliability of the liquid discharging apparatus 1.

5.3 Configuration of Connection Detection Circuit

Here, a description will be given of the configuration of the connection detection circuit 220 (the connection detection circuits 220-1 and 220-2) using FIG. 15. Since the connection detection circuit 220-1 and the connection detection circuit 220-2 illustrated in FIG. 12 have the same configuration, the description will be given for the connection detection circuit 220.

Figure 15:
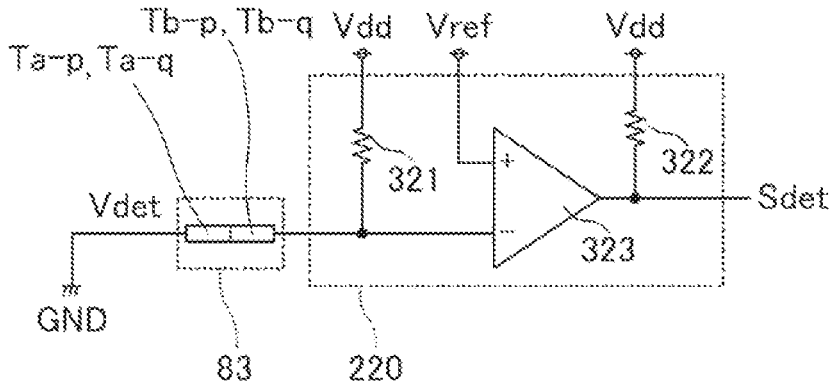
FIG. 15 is a circuit diagram illustrating a configuration of a connection detection circuit.

FIG. 15 is a circuit diagram illustrating the circuit configuration of the connection detection circuit 220.

The connection detection circuit 220 is provided with a resistance 321, a resistance 322, and a comparator 323.

The comparator 323 includes an inverting input terminal (−), a non-inverting input terminal (+), and an output terminal.

The comparator 323 sets the output terminal to high impedance when the signal which is input to the inverting input terminal (−) is smaller than the signal which is input to the non-inverting input terminal (+). Meanwhile, when the signal which is input to the inverting input terminal (−) is greater than the signal which is input to the non-inverting input terminal (+), the comparator 323 outputs an L level from the output terminal.

One end of the resistance 321 and the terminal Tb-p (or the terminal Tb-q) of the B-to-B connector 83 (the second connector) are connected to the inverting input terminal (−) (an example of "a first input terminal"). The voltage Vdd is supplied to the other end of the resistance 321. Here, the voltage Vdd is a voltage signal of a predetermined voltage value, for example, a voltage value of DC 3.3 V is input.

The reference voltage Vref (an example of "a reference potential") is input to the non-inverting input terminal (+) (an example of "a second input terminal"). Here, the voltage Vref is a voltage signal of a smaller voltage value than the voltage Vdd, for example, a voltage value of DC 1.5 V is input.

One end of the resistance 322 is connected to the output terminal and the other end of the resistance 322 is connected to the voltage Vdd. A signal indicating the comparison result which is output from the output terminal is input to the control circuit 210 as the detection signal Sdet.

In the connection detection circuit 220 which is configured as described above, when the B-to-B connector 83 is correctly connected, that is, when the terminal Tb-p (or the terminal Tb-q) of the second connector 84*b* and the terminal Ta-p (or the terminal Ta-q) of the first connector 84*a* are shorted, a voltage signal of the reference potential (the ground potential) is input to the inverting input terminal (−) of the comparator 323 as the voltage Vdet.

At this time, the comparator 323 sets the output terminal to high impedance since the voltage value which is input to the inverting input terminal (−) is smaller than the reference potential Vref which is input to the non-inverting input terminal (+). Therefore, the connection detection circuit 220 outputs the voltage Vdd (the H level signal) which is input via the resistance 322 as the detection signal Sdet.

Meanwhile, when the B-to-B connector 83 is not correctly connected, the terminal Tb-p (or the terminal Tb-q) of the second connector 84*b* and the terminal Ta-p (or the terminal Ta-q) of the first connector 84*a* are released. Accordingly, the voltage Vdd is input to the inverting input terminal (−) of the comparator 323 via the resistance 321.

At this time, the comparator 323 outputs the L level signal as the detection signal Sdet since the voltage value which is input to the inverting input terminal (−) is greater than the reference potential Vref which is input to the non-inverting input terminal (+).

As described above, when the B-to-B connector 83 is correctly connected, the connection detection circuit 220 outputs the H level signal as the detection signal Sdet, and when the B-to-B connector 83 is not correctly connected, the connection detection circuit 220 outputs the L level signal as the detection signal Sdet.

Accordingly, the control circuit 210 is capable of determining whether or not the B-to-B connector 83 is correctly connected, stopping the operation of the liquid discharging apparatus 1 in the detection determination circuit 213, and performing an operation such as notification using a notification unit (not illustrated).

The configuration of the connection detection circuit 220, the voltage level of the voltage Vdet, and the signals which are output are not limited to those described above.

For example, in the configuration of FIG. 15, a voltage signal of the same potential as the voltage Vdd may be supplied as the voltage Vdet. At this time, when the B-to-B connector 83 is correctly connected, the connection detection circuit 220 outputs the L level signal as the detection signal Sdet, and when the B-to-B connector 83 is not correctly connected, the connection detection circuit 220 outputs the H level signal as the detection signal Sdet.

A configuration may also be adopted in which the connection detection circuit 220 is provided with a plurality of comparators, outputs the H level (or the L level) signal as the detection signal Sdet with the assumption that the B-to-B connector 83 is correctly connected when the voltage Vdet which is input via the B-to-B connector 83 is a voltage of a predetermined range, and outputs the L level (or the H level) signal as the detection signal Sdet with the assumption that the B-to-B connector 83 is not correctly connected when the voltage Vdet which is input via the B-to-B connector 83 is not a voltage of a predetermined range.

6. Operations and Effects

As described above, in the liquid discharging apparatus 1 in the present embodiment, the drive circuits 311 and 312 which generate the drive voltages COM-A and COM-B and the first connector 84*a* are provided on the drive circuit board 30 and the first connector 84*a* is connected to the second connector 84*b* which is provided on the control circuit board 20. At this time, the terminals Ta-p and Ta-q for detecting the connection between the first connector 83*a* and the second connector 84*b* are provided on the first connector 84*a* and the terminals Tb-p and Tb-q for detecting the connection between the first connector 84*a* and the second connector 84*b* are provided on the second connector 83*b*. Due to the terminals Ta-p, Ta-q, Tb-p, and Tb-q being provided on the first connector 84*a* and the second connector 83*b*, for the detection of the connection between the first connector 84*a* and the second connector 83*b*, it is possible to perform direct detection based on the signals which are propagated by the first connector 84*a* and the second connector 83*b*. Accordingly, it is possible to increase the detection precision of the connection between the first connector 84*a* and the second connector 83*b*.

In the liquid discharging apparatus 1 in the present embodiment, the connection detection terminals Ta-p and Ta-q which are provided on the first connector 84*a* are provided on both end portion sides of the terminal row in which the m terminals Ta, which are provided to line up on the first connector 83*a*, are formed, and similarly, the connection detection terminals Tb-p and Tb-q which are provided on the second connector 84*b* are provided on both end portion sides of the terminal row in which the m terminals Tb, which are provided to line up on the second connector 83*b*, are formed. Accordingly, it is possible to increase the detection precision in a case in which the connection between the first connector 84*a* and the second connector 84*b* is performed in a slanted manner.

As described above, in the liquid discharging apparatus 1 in the present embodiment, it is possible to precisely detect whether the connection between the first connector 84*a* and the second connector 84*b* which are included in the B-to-B connector 83 is good or poor. Accordingly, it is possible to reduce the connection faults which arise between the first connector 84*a* and the second connector 83*b*. Therefore, in a case in which the discharge head 40 includes many (greater than or equal to 2400) nozzles 651, even in a case in which the first connector 83*a* and the second connector 84*b* include the many terminals at high density, it is possible to reduce connection faults which arise between the first connector 84*a* and the second connector 83*b*.

Hereinabove, although a description is given of embodiments and modification examples, the invention is not limited to these embodiments and it is possible to implement various embodiments of the invention as long as the gist of the invention is not departed from. For example, it is possible to combine the embodiments, as appropriate.

The invention includes configurations which are the substantially the same as the configurations described in the embodiments (for example, configurations having the same function, method, and results, or configurations having the same purpose and effect). The invention includes configurations in which non-essential parts of the configurations described in the embodiments are replaced. The invention includes configurations exhibiting the same operations and effects as the configurations described in the embodiments or configurations capable of achieving the same purpose. The invention includes configurations in which known techniques are added to the configurations described in the embodiments.

What is claimed is:

1. A liquid discharging apparatus comprising:

a first substrate which includes a drive circuit and a first connector, the drive circuit generating a drive signal;

a discharge head which includes nozzles, a density of the nozzles being greater than or equal to 300 nozzles per inch, a total number of the nozzles being greater than or equal to 600 nozzles, the discharge head receiving the drive signal, the discharge head discharging a liquid from the nozzles; and a second substrate which includes a second connector which is connected to the first connector, wherein at least one of the first connector and the second connector includes a detection terminal for detecting a connection with the other of the first connector and the second connector, wherein the first substrate is configured by a plurality of the first substrates, and the plurality of the first substrates are connected to the second substrate, and wherein the discharge head is configured by a plurality of the discharge heads, and the plurality of the discharge heads are provided corresponding to the plurality of first substrates.

2. The liquid discharging apparatus according to claim 1, wherein the first connector includes a plurality of first terminals which form a first terminal row, wherein the plurality of first terminals includes the detection terminal, and wherein the detection terminal is provided on one end side or both end sides of the first terminal row.

3. The liquid discharging apparatus according to claim 1, wherein the second connector includes a plurality of second terminals which form a second terminal row, wherein the plurality of second terminals includes the detection terminal, and wherein the detection terminal is provided on one end side or both end sides of the second terminal row.

4. The liquid discharging apparatus according to claim 1, wherein the discharge head includes a plurality of discharge modules, wherein the nozzles are provided on each of the plurality of discharge modules, and wherein the drive signal is supplied to each of the plurality of discharge modules.

5. The liquid discharging apparatus according to claim 1, further comprising:

a detection circuit which detects a connection between the first connector and the second connector, wherein the detection circuit includes a comparator, and wherein the comparator includes a first input terminal which is connected to the detection terminal, a second input terminal which receives a reference potential, and an output terminal which outputs a signal indicating a result of a comparison between the first input terminal and the second input terminal.

6. A liquid discharging apparatus comprising:

a first substrate which includes a drive circuit and a first connector, the drive circuit generating a drive signal;

a discharge head including nozzles, a density of the nozzles being greater than or equal to 300 nozzles per inch, a total number of the nozzles being greater than or equal to 600 nozzles, the discharge head receiving the drive signal, the discharge head discharging a liquid from the nozzles;

a second substrate which includes a second connector which is connected to the first connector;

a detection terminal which is provided on the first connector or the second connector; and a comparator which includes a first input terminal which is connected to the detection terminal, a second input terminal which receives input of a reference potential, and an output terminal which outputs a result of a comparison between the first input terminal and the second input terminal.

7. A liquid discharging apparatus comprising:

a first substrate which includes a drive circuit and a first connector, the drive circuit generating a drive signal;

a discharge head which includes nozzles, a density of the nozzles being greater than or equal to 300 nozzles per inch and a total number of the nozzles being greater than or equal to 600 nozzles, the discharge head receiving the drive signal, the discharge head discharging a liquid from the nozzles; and a second substrate which includes a second connector which is connected to the first connector, wherein at least one of the first connector and the second connector includes a detection terminal for detecting a connection with the other of the first connector and the second connector, the first connector includes a plurality of first terminals which form a first terminal row, the plurality of first terminals include the detection terminal, and the detection terminal is provided on one end side or both end sides of the first terminal row.

* * * * *